US008754371B2

(12) United States Patent
Hunter et al.

(10) Patent No.: US 8,754,371 B2
(45) Date of Patent: Jun. 17, 2014

(54) METHODS, APPARATUS, AND SYSTEM FOR MASS SPECTROMETRY

(75) Inventors: Ian W. Hunter, Lincoln, MA (US); Brian D. Hemond, Cambridge, MA (US); Harold F. Hemond, Lexington, MA (US)

(73) Assignee: The Massachusetts Institute of Technology, Cambridge, MA (US)

( * ) Notice: Subject to any disclaimer, the term of this patent is extended or adjusted under 35 U.S.C. 154(b) by 18 days.

(21) Appl. No.: 13/396,321

(22) Filed: Feb. 14, 2012

(65) Prior Publication Data

US 2012/0205534 A1 Aug. 16, 2012

Related U.S. Application Data

(60) Provisional application No. 61/442,385, filed on Feb. 14, 2011, provisional application No. 61/565,763, filed on Dec. 1, 2011.

(51) Int. Cl.
*H01J 49/24* (2006.01)
*H01J 49/28* (2006.01)

(52) U.S. Cl.
USPC ..... 250/294; 250/281

(58) Field of Classification Search
USPC ..... 250/281, 289, 294, 298, 299
See application file for complete search history.

(56) References Cited

U.S. PATENT DOCUMENTS 4,500,791 A * 2/1985 Beisswenger ..... 250/493.1
4,983,831 A 1/1991 Migeon et al.
5,155,357 A 10/1992 Hemond
5,313,061 A * 5/1994 Drew et al. ..... 250/281
5,374,827 A * 12/1994 Roy ..... 250/397
5,401,963 A 3/1995 Sittler
6,316,768 B1 11/2001 Rockwood et al.
6,782,342 B2 8/2004 LeGore et al.
6,831,276 B2 12/2004 Berger et al.
7,021,981 B2 4/2006 Onishi et al.
7,031,877 B2 4/2006 LeGore et al.
7,403,867 B2 7/2008 LeGore et al.
7,442,920 B2 10/2008 Scheidemann et al.
7,498,569 B2 3/2009 Ding
7,638,766 B1 * 12/2009 Schoen ..... 250/292
2002/0185593 A1 * 12/2002 Doring ..... 250/287
2003/0193021 A1 * 10/2003 Berger et al. ..... 250/299
2004/0206899 A1 10/2004 Webb et al.
2004/0245448 A1 12/2004 Glish et al.
2005/0017166 A1 1/2005 Scheidemann et al.
2005/0263714 A1 12/2005 Vassiliou et al.
2006/0076483 A1 * 4/2006 Scheidemann et al. ..... 250/289
2006/0255255 A1 * 11/2006 Miller et al. ..... 250/281

OTHER PUBLICATIONS

International Search Report and Written Opinion in PCT/US2012/25032 dated Aug. 10, 2012.

* cited by examiner

*Primary Examiner* — Jack Berman
*Assistant Examiner* — David E Smith
(74) *Attorney, Agent, or Firm* — Cooley LLP

(57) ABSTRACT

A miniature, low cost mass spectrometer capable of unit resolution over a mass range of 10 to 50 AMU. The mass spectrometer incorporates several features that enhance the performance of the design over comparable instruments. An efficient ion source enables relatively low power consumption without sacrificing measurement resolution. Variable geometry mechanical filters allow for variable resolution. An onboard ion pump removes the need for an external pumping source. A magnet and magnetic yoke produce magnetic field regions with different flux densities to run the ion pump and a magnetic sector mass analyzer. An onboard digital controller and power conversion circuit inside the vacuum chamber allows a large degree of flexibility over the operation of the mass spectrometer while eliminating the need for high-voltage electrical feedthroughs. The miniature mass spectrometer senses fractions of a percentage of inlet gas and returns mass spectra data to a computer.

25 Claims, 35 Drawing Sheets

METHODS, APPARATUS, AND SYSTEM FOR MASS SPECTROMETRY

CROSS-REFERENCE TO RELATED PATENT APPLICATIONS

This application claims the benefit, under 35 U.S.C. §119 (e), of U.S. Provisional Patent Application No. 61/442,385, filed on Feb. 14, 2011, entitled "Mass Spectrometer," which application is hereby incorporated herein by reference.

This application also claims the benefit, under 35 U.S.C. §119(e), of U.S. Provisional Patent Application No. 61/565,763, filed on Dec. 1, 2011, entitled "A Structurally Robust, Miniature Mass Spectrometer incorporating Self-Aligning Ion Optics," which application is hereby incorporated herein by reference.

BACKGROUND

Mass spectrometry is one of the leading chemical analysis tools. A mass spectrometer, often used as a detector in conjunction with another instrument (e.g., a gas chromotograph), may be capable of determining the relative abundances of the chemical species present in a gaseous sample by separating the species by atomic mass.

Mass spectrometry is widely used across many disciplines. Mass spectrometers have been sent aboard unmanned spacecraft; both of the Viking landers carried gas chromotograph/mass spectrometer (GCMS) packages, and the Cassini-Huygens probe dropped into Titan's atmosphere carried a GCMS as well. Mass spectrometers are heavily used in the biological sciences; they are one of the commonly used methods of determining protein structure and sequence.

In the medical field of pharmacokinetics, mass spectrometry has been used to track extremely small quantities of drugs through the human body.

Mass spectrometers have been designed for chemical and biological defense; the Block II chemical biological mass spectrometer (CBMS) was designed to be a portable, vehicle mounted instrument capable of detecting chemical and biological threats (e.g., nerve agents, bacteria) in the field. More recently, mass spectrometers have been carried aboard unmanned submersibles to aid in the tracking of hydrocarbons released by the Macondo oil well failure in the Gulf of Mexico on Apr. 20, 2010.

Many other fields have employed mass spectrometry as well. As early as 1976, a mass spectrometer was used to continuously analyze the respired gases of patients on ventilators in intensive care for potentially dangerous complications.

SUMMARY

The Applicants have recognized that the conventional mass spectrometer is an extremely versatile instrument, but it is not without some drawbacks. A conventional mass spectrometer is generally a large, complex, and expensive instrument that may consume a substantial amount of electrical power.

In view of the foregoing, inventive embodiments disclosed herein relate in part to improved mass spectrometers, which, in various aspects, may be small enough to be handheld, capable of running in remote usage on minimal power for a useful length of time, and inexpensive enough to build and assemble such that it can be widely deployed. An illustrative instrument may be deployed in large numbers to blanket wide areas for air or water quality monitoring, installed in industrial exhaust stacks for combustion process feedback control, or attached to hospital ventilators or used as first response tools in emergency rooms.

Embodiments of the present invention include mass spectrometers and corresponding methods of mass spectrometry. One illustrative mass spectrometer includes a vacuum housing defining a vacuum cavity to support a vacuum of about $10^{-5}$ mm Hg or less along with an electrode and a conversion circuit disposed within the vacuum cavity. A feedthrough with a dielectric strength of about 36 V or below provides an electrical connection between the conversion circuit and a power source outside the vacuum cavity. In some examples, the feedthrough may provide the only electrical connection between the inside of the vacuum cavity and the outside of the vacuum cavity. The conversion circuit receives an input voltage (e.g., at a first value of about 1 V to about 36 V) from the power source via the feedthrough and converts the input voltage to an electrode potential (e.g., at a second value of about 100 V to about 5 kV) and charges the electrode to the electrode potential. Once charged to the electrode potential, the electrode controls acceleration of a charged particle propagating through the vacuum cavity.

In one example, the charged particle is an electron. In such an example, the mass spectrometer may further include an electron source, disposed within the vacuum cavity, to provide the electron; a cathode to repel the electron; and an anode, disposed on a side of the control electrode opposite the electron source, to accelerate the electron toward a particle to be analyzed. The conversion circuit may be configured to provide: an anode potential of about 100 V to about 5 kV for the anode; a cathode potential of about 70 V below the anode potential for the cathode; and the electrode potential of about 0 V and about 140 V below the anode potential.

Such a mass spectrometer may also include electronics (e.g., a microprocessor, an analog-to-digital converter, or a digital-to-analog converter), disposed within the vacuum cavity, to control or vary the electrode potential (e.g., to control acceleration of the electron). The electronics may also be coupled to a detector that determines a mass of the charged particle based on the acceleration of the charged particle.

Another illustrative mass spectrometer and corresponding method of mass spectrometry includes a magnet in a magnetic yoke to generate a magnetic field having a first strength (e.g., about 0.1 T) in a first region and a second strength (e.g., about 0.7 T) in a second region. It also includes a vacuum housing defining a vacuum cavity, an ion pump disposed in the first region to maintain the vacuum pressure of the vacuum cavity, and a mass analyzer (e.g., a magnetic sector analyzer) disposed in the second region to determine the mass of a particle propagating through the vacuum cavity. A control electrode disposed within the vacuum cavity controls acceleration of an electron that ionizes the particle, and a conversion circuit disposed within the vacuum cavity provides one or more voltages to the ion pump, the electrode, and/or the mass analyzer.

A further example of the illustrative mass spectrometer may include control electronics, disposed within the vacuum cavity and in electrical communication with the control electrode, to vary a potential of the control electrode. It may also include signal processing electronics, disposed within the vacuum cavity and powered by the conversion circuit, to process signals provided by the mass analyzer.

Such a mass spectrometer may also include an electron source, disposed within the vacuum cavity, to provide the electron; a cathode to shield the electron source from the vacuum cavity; and an anode, disposed on a side of the control electrode opposite the electron source, to accelerate the electron toward a particle to be analyzed. The conversion circuit may be configured to provide an anode potential of about 100 V to about 5 kV for the anode, a cathode potential about 70 V below the anode potential for the cathode, and the electrode potential, which may be about 0 V and about 140 V below the anode potential. In addition, the conversion circuit may be configured to step up the input voltage, with a first value of about 1 V to about 36 V, to the electrode potential at a second value of about 100 V to about 5 kV.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Following below are more detailed descriptions of various concepts related to, and embodiments of, inventive systems, methods and apparatus for mass spectrometry. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

1.0 OVERVIEW OF MASS SPECTROMETRY

Many different implementations of mass spectrometers exist, and the configuration often depends on the intended application. Generally, however, they include the same basic functional blocks: an inlet, an ion source, a mass analyzer, a detector, and a vacuum system. Samples entering the inlet are ionized, usually by bombardment with an electron beam, then separated by mass using one or more electric and/or magnetic fields, then analyzed for relative abundance.

Ultimately, all of the implementations of the mass spectrometer produce a graph relating the atomic mass-to-charge (m/z) ratios of the components of the ionized sample to the relative abundance of each component. For example, a mass spectrometer measuring a sample of atmosphere would find components at masses 28, 32, 40, and 44, and possibly others depending on the sensitivity of the instrument. These masses correspond to nitrogen, oxygen, argon, and carbon dioxide. The mass spectrometer output will show the highest signal strength for mass 28, nitrogen, which comprises 70% of atmospheric gas, followed by about ⅓ the signal strength of the nitrogen peak for oxygen, at 32 (22% of the atmosphere), and lower signal strengths still for argon and carbondioxide.

Mass spectrometers are generally designed for specific mass ranges and resolutions, depending on the application. Mass ranges might be 10 to 50 AMU for an instrument designed for environmental gas monitoring, or many tens of thousands of AMU for in instrument used in protein analysis. The mass spectrometer often scans through this mass range by varying one of the electric or magnetic field parameters, producing a spectrum in both mass-to-charge (m/z) ratio and, undesirably, time. The scan will produce peaks in signal intensity where masses are present. The resolution of the mass spectrometer is determined by how narrow these peaks are; some mass spectrometers may only resolve unit masses while some may resolve extremely small fractions of mass (e.g., for distinguishing different species that appear at the same nominal unit mass, such as carbon monoxide at 28.010 and nitrogen at 28.0134). Peaks are often characterized by full-width half-maximum (FWHM) measurements; the width of the peak at half of its amplitude can help in determining which masses will be visible. In general, mass spectrometers that produce narrower peaks have better resolving power than those with wide peaks.

Figure 1A:
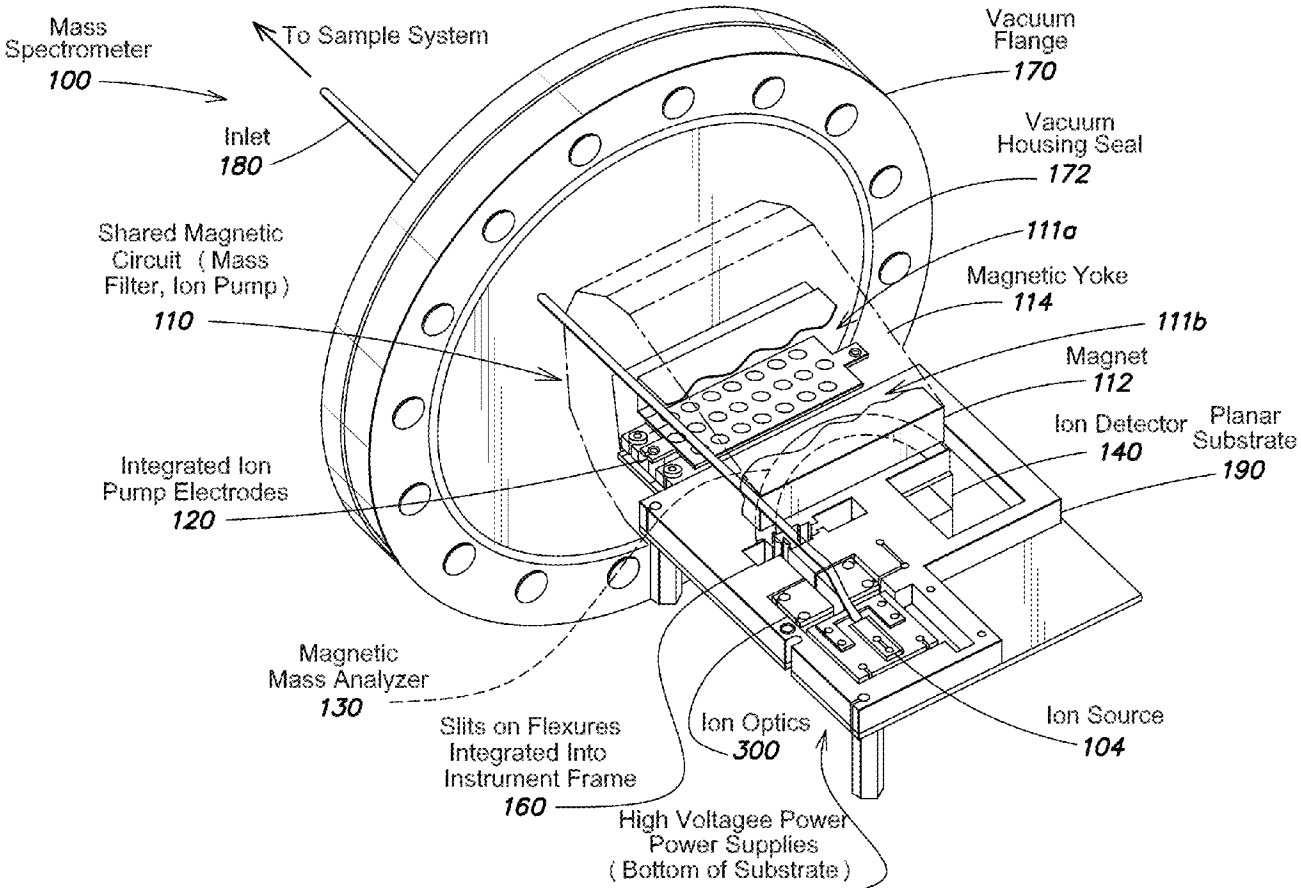
FIG. 1A is a computer-aided design (CAD) model of an exemplary mass spectrometer, according to an embodiment of the present invention.

FIG. 1A shows an isometric view of a computer-aided design (CAD) model of an exemplary mass spectrometer 100, shown without the vacuum housing for purposes of illustration. The components shown in FIG. 1A are within a vacuum cavity defined by the vacuum housing and a vacuum flange 170 unless noted otherwise. A vacuum housing seal 172 extending along a surface of the vacuum flange prevents leaks, allowing the vacuum pressure to reach 1e-5 torr or less. An inlet 180 extending through the vacuum flange 170 to permit introduction of samples for analysis.

The mass spectrometer 100 includes a shared magnetic circuit 110 formed of one or more magnets 112 within a magnetic yoke 114. The yoke 114 couples magnetic flux from the magnets 112 into two or more magnetic field regions 111*a* and 111*b*. An ion pump (shown in FIG. 1A as integrated ion pump electrodes 120) in the first region 111*a* maintains the vacuum pressure inside the vacuum cavity, and a magnetic sector mass analyzer 130 in the second region 111*b* separates ionized sample particles according to mass as understood in the art. An ion source 104 generates the ions, which are collimated with ion optics 300, by ionizing particles admitted through the inlet 180 with electrons from an electron source (not shown). An ion detector 140 at one end of the magnetic mass analyzer 130 generates a current that varies with the number of ions collected by the detector 140.

The mass analyzer 130 and ion detector 140 are mounted on a planar substrate 190, which can be made from printed circuit board (PCB) material as described below, that also supports a conversion circuit (high-voltage power supplies) 150. The substrate 190 is mounted to the vacuum flange 170 via the magnetic yoke 114. Those of ordinary skill in the art will readily appreciate that other mounting configurations are possible as well.

The conversion circuit 150 converts, or steps up, an input voltage of about 1-36 V (e.g., 12 V) from an external power supply to a voltage high enough to charge the electrodes inside the vacuum cavity (e.g., 100 V to 5 kV), including any electrodes in the electron source, ion source 104, ion optics 300, and ion detector 140. The conversion circuit 150 may be coupled to the external power supply via a single feedthrough (not shown) that has a relatively low dielectric strength (e.g., a dielectric strength of equal to or less than about 36 V or less, equal to or less than about 24 V, equal to or less than about 12 V, or equal to or less than about 9 V). In at least one embodiment, this low-dielectric-strength feedthrough is the only electrical connection between the interior and exterior of the vacuum cavity defined by the vacuum flange 170 and the vacuum housing (not shown).

Figure 1B:
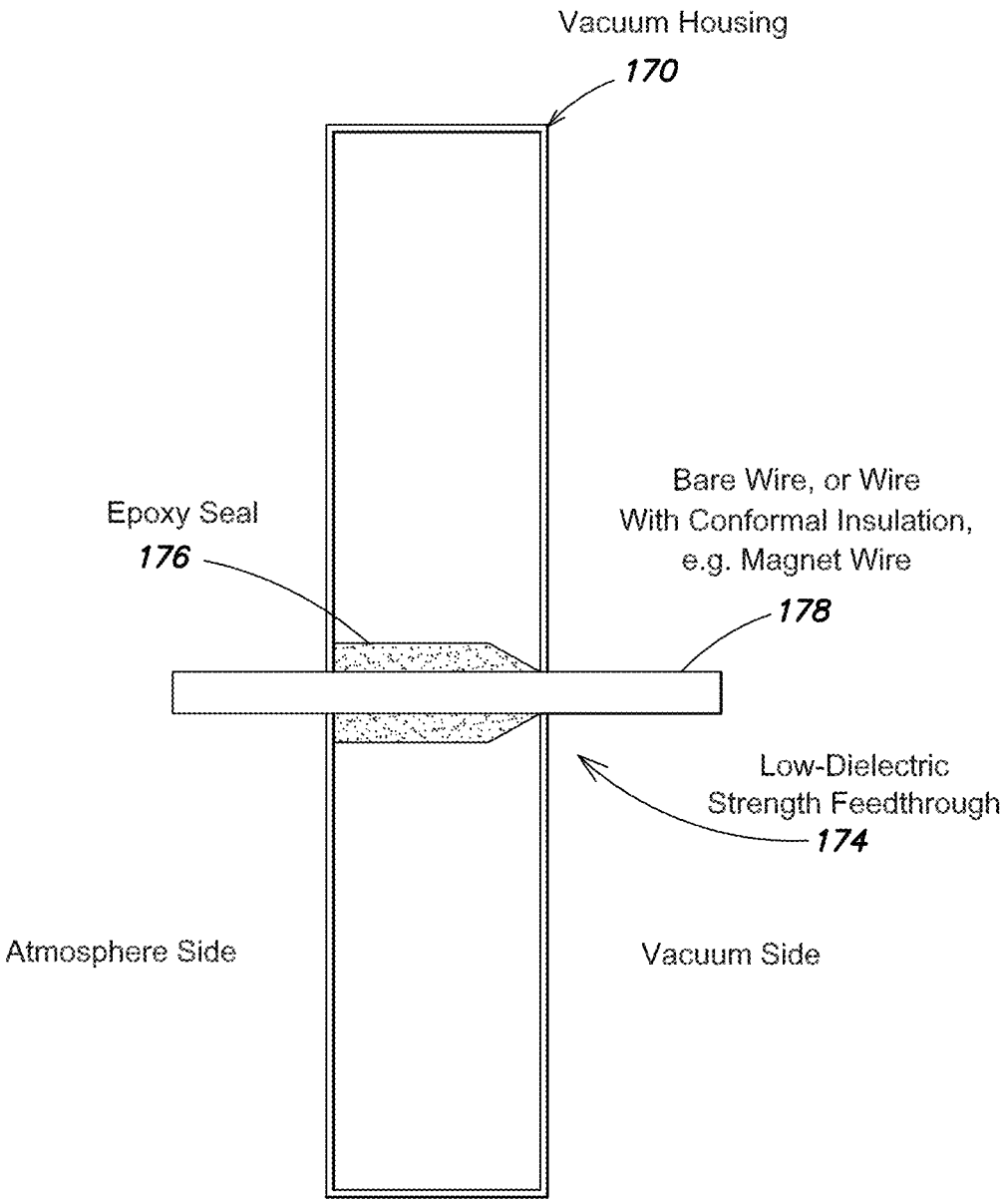
FIG. 1B is a diagram of a low-dielectric-strength feedthrough suitable for use with the mass spectrometer of FIG. 1A, according to an embodiment of the present invention.

FIG. 1B shows a low-dielectric-strength feedthrough 174 suitable for use with the conversion circuit 150, vacuum housing, and vacuum flange 170 of FIG. 1A. Such a low-dielectric-strength feedthrough 174 can be made quickly and inexpensively with epoxy and may have a dielectric strength of equal to or less than about 36 V or less. To make the feedthrough 174, a small hole is drilled through the vacuum housing (e.g., through the vacuum flange 170), tapered towards the vacuum side to a diameter just large enough to accept a feedthrough wire 178, which may be bare or coated with conformal insulation (e.g., magnet wire). The wire 178 is positioned and the hole backfilled with low outgassing epoxy to form an epoxy seal or plug 176. In this configuration, the epoxy plug 176 sees little force; the vacuum flange 170 or housing still carries the load because the hole is mostly filled by wire 178 and the epoxy 176 holds the wire 178 in place. Using bare or conformally coated wire reduces the change of vacuum leaks between the wire 178 and its insulation layer, as might happen with wire that is insulated with a separate jacket.

Placing the conversion circuit 150 inside the vacuum cavity is counterintuitive because even the most efficient conversion circuit 150 dissipates energy in the form of heat. This heat raises the temperature of other components in the cavity, including the substrate 190. As the other components heat up, they may release absorbed or adsorbed gases, which causes the pressure inside the cavity to rise, increasing the load on the ion pump 120.

But placing the conversion circuit 150 inside the vacuum cavity makes it possible to eliminate high-voltage electrical feedthroughs, which are typically expensive and difficult to manufacture. Unlike low-dielectric-strength feedthroughs, high-voltage electrical feedthroughs typically need to provide a vacuum-tight electrical connection that can withstand hundreds or thousands of volts with respect to the vacuum housing, and can be baked at hundreds of degrees Celsius. They are often fashioned out of Kovar and brazed to a ceramic dielectric, which is in turn brazed to a stainless steel housing or fitting.

2.0 TYPES OF MASS SPECTROMETERS

Many different types of mass spectrometer exist, generally classified by the method used to separate the different masses. This section briefly covers some of the simpler types of mass spectrometer, and although nowhere near comprehensive, describes those that have potential to be manufactured inexpensively.

2.1 Types of Mass Analyzers

A magnetic-sector mass spectrometer (e.g., mass analyzer 130 shown in FIG. 1A) produces a spatial separation in mass. In this design, ionized samples are accelerated in an electric field and injected into a region with a perpendicular magnetic field. The radius of curvature of the ion's trajectory in the magnetic field is proportional to its mass and inversely proportional to its charge state. By scanning either the electric field, and therefore varying the ion's kinetic energy, or scanning the magnetic field and varying the ion's trajectory, the various masses can be separated and detected independently. Many variants of this design exist, including some with separate or combined electric and magnetic sectors, producing improved resolution.

A time-of-flight mass spectrometer is another design that produces a temporal separation in mass. Ions are injected into a drift region by a fixed electric field; the separation in ultimate ion velocity and therefore arrival time at the far end of the drift region is proportional to ion mass.

A quadrupole mass spectrometer uses two pairs of electrodes parallel to an ion flight path; by applying a variable-frequency RF field using one electrode pair and a DC bias on another, and tuning the RF field for a specific mass, only one mass at any given time has a stable trajectory through the fields.

A similar type of mass spectrometer, the ion trap mass spectrometer, uses principles similar to the quadrupole mass spectrometer to trap clouds of ions in a volume and selectively make the orbits of specific masses unstable. The unstable masses are then ejected from the ion volume and measured.

2.2 Ion Sources

Mass analyzers typically rely on ionized samples injected into the mass spectrometer to function properly. Once the sample is ionized, the ionized sample molecules (the ions) may be manipulated and separated by electromagnetic fields.

Common ion sources use electron ionization. In this type of source, an electron beam, usually generated thermionically, is aimed into a gaseous sample. Electrons interacting with sample molecules remove electrons from the sample, producing positively charged sample ions, although negative ion mass spectrometry is practical for some electronegative chemical species.

2.3 Detectors

Once a sample has been ionized and the resulting ions separated by mass, the ions can be detected with a detector (e.g., detector 140 in FIG. 1A). The simplest detector is a Faraday cup followed by a high gain transconductance amplifier. Ions striking the Faraday cup produce a tiny but measurable current that is then amplified and recorded. However, since these detectors provide no intrinsic gain, the noise floor is that of the amplifier.

3.0 MASS SPECTROMETER DESIGN OVERVIEW

An illustrative embodiment of the miniature mass spectrometers disclosed herein may have a simple, robust design that can be made without complicated or labor-intensive manufacturing techniques. Each design choice may involve a tradeoff among multiple factors, among them performance, size, weight, power consumption, complexity, ease of manufacture, and cost. Such a design may be manufacturable using automated machine tools. Manufacturing can be simplified further by creating a planar design that relies on two-dimensional (2D) machining; any features in the third dimension can be built or approximated by stacking multiple layers of 2D-machined components. Eliminating secondary machining operations can help to eliminate extra fixturing, time, and waste. Thus, in at least one case, the design incorporates many co-fabricated features.

In one example, an inventive mass spectrometer comprises a single unit that may be operated in a simple, cylindrical vacuum chamber with a port for gas inlet, several low-voltage cables, and a port for a roughing vacuum pump. These ports may be implemented with thin tubing or cabling fed through the vacuum chamber wall and embedded in epoxy.

An exemplary mass spectrometer can be designed with a number of potential applications in mind, but for the most part, with common performance requirements. For instance, it could be designed and built for unit resolution (i.e., it can discriminate between ions one or more integer mass units distant) with enough sensitivity to detect species comprising of 0.5% or more of the analyte gas at an operating pressure of 1e-4 Pa (1e-6 torr). It can also carry its own high vacuum pump onboard; while slightly less versatile than a design incorporating both the high vacuum and roughing pumps, the substantial savings in cost, weight, and complexity may be invaluable. Such an exemplary mass spectrometer may be able to run on its own for long periods of time with low power consumption as well as low maintenance.

An instrument providing this level of performance is of limited utility if the production cost is comparable to that of an existing commercial instrument (e.g., tens of thousands of dollars). The mass spectrometer can be quite inexpensive (e.g., on the order of $1000), making it suitable for large-scale deployment in novel applications. Figuring into the cost of the mass spectrometer is ease of manufacture and complexity; difficult or skilled manufacturing techniques and/or large numbers of parts may make the design more expensive to build.

Minimizing power consumption is also important for certain applications. For instance, a mass spectrometer meeting the above specifications may be well-suited for a variety of remote or portable applications, in which the mass spectrometer can run for long periods of time off batteries, solar power, wind power, or another energy source.

In one embodiment, the miniature mass spectrometer is a single-focusing, 180-degree magnetic sector mass spectrometer. A magnetic sector mass spectrometer can be constructed using layers of planar components, greatly reducing the cost of the instrument, as most simple manufacturing techniques are two-dimensional. The geometries involved are simple and no high power RF oscillators or high speed timing abilities are needed, as may be the case with a quadrupole or time-of-flight mass spectrometer, respectively. Other mass spectrometer types, such as ion trap or Fourier-transform types, can be demanding in terms of geometry, power, or complexity.

A set of permanent magnets and yoke creates the magnetic field for the mass analyzer. With the ready availability of NdFeB magnets this is an obvious choice; an electromagnet requires too much power for a small instrument. Additionally, a second benefit is available with a permanent magnet. By carefully choosing the sizes of the pole pieces for the yoke, the design can incorporate an ion pump into the same magnetic circuit that encloses the analyzer, thus saving on complexity, size, and parts count. The length of the magnetic sector analyzer may be 180 degrees, simplifying the layout and minimizing the size of the design by placing the ion source and detector on the same side of the instrument. The design of each subsystem of the mass spectrometer is detailed in the following sections.

In another embodiment, the upper and lower mass analyzer include an electric sector, changing the overall mass spectrometer topology to that of a Nier-Johnson double-focusing mass spectrometer, possibly more than doubling the mass resolution.

3.1 Vacuum System Design

During operation, the entire length of the ion flight path is kept at high vacuum, i.e., at pressures below 1e-4 Pa (1e-6 torr). At higher pressures (lower vacuum), the mean free path for an ion becomes too short for enough of them to transit the entire length of the flight path. This criterion alone necessitates the use of a vacuum system with very tight tolerances to reduce the leak rate, as well as a vacuum pump capable of producing the high vacuum.

At the same time, the mass spectrometer's vacuum system may have to contend with a constant influx of gas; the gas entering the system from the inlet should be continuously pumped back out or captured lest the vacuum chamber pressure rise to an unacceptable level. Thus, the vacuum system may also incorporate a one or more vacuum pumps capable of pumping faster than the inlet leak rate.

In most mass spectrometers, the vacuum system is a very expensive part of the design. Compared to the cost of a typical instrument, the vacuum system may not be a large percentage of the overall cost, but for a miniature inexpensive design, the vacuum components alone may easily dominate the budget. High vacuum components, even standard fittings, are extremely expensive. Nearly every component is constructed of machined or formed stainless steel, typically with welded junctions. Mass spectrometers often use custom vacuum components just due to the geometry of the instrument. For example, a magnetic sector mass spectrometer often has a formed, thin-walled, welded section of stainless steel tubing welded to high vacuum flanges for the mass analyzer. This is typically because the mass analyzer's flight path should fit between the poles of the magnet, and the gap is rarely a standard size.

Moreover, electrical signals are fed into and out of a typical mass spectrometer vacuum system, with one feedthrough for every voltage in the system. In a conventional mass spectrometer, there may be anywhere from five to ten or more separate potentials at different points within the vacuum system. Feedthroughs for high voltages can be especially expensive because they are made by brazing Kovar conductors with ceramic insulators and stainless steel flanges. Because of the cost and complexity using multiple feedthroughs (including high-voltage feedthroughs), illustrative mass spectrometers may be designed and built to operate with a small number (e.g., one or two) of signals penetrating the vacuum chamber.

One way to reduce vacuum system cost and complexity is to reduce the number of components involved. For instance, a miniature mass spectrometer can be designed to fit, in its entirety (including magnets, power and control electronics, high vacuum pump, and ion optics, etc.), within a vacuum chamber that has a 100 mm diameter and a 150 mm length. An exemplary mass spectrometer can be mounted on a single vacuum flange through which all of the electrical signals and the inlet pass, and the vacuum chamber can therefore include a 100 mm diameter cylindrical pipe for simplicity. Indeed, a simple but smaller vacuum chamber could be constructed that follows the contours of the instrument to reduce size and weight.

To reduce the number of electrical feedthroughs, the data can be handled digitally and control signals can be generated inside the vacuum housing by an onboard control system. In this manner, the system uses one, two, or three low-voltage electrical signals (e.g., power and one or two data lines) fed through the vacuum chamber walls. These electrical lines may be simple lengths of cable embedded in low-outgassing epoxy, since high isolation is not necessary. Ground reference can be the chamber itself.

Alternatively, or in addition, the system may be capable of transmitting data wirelessly (e.g., via infrared or RF channels) through the vacuum chamber walls, making only a single electrical feedthrough for power necessary. In addition, the system could be powered inductively (e.g., via coil loop antennas), eliminating any need for a feedthrough to connect the inside and outside of the vacuum chamber.

In another example, the miniature mass spectrometer incorporates a co-fabricated ion pump, designed to use the same permanent magnet and yoke assembly that the mass analyzer uses, to maintain a high vacuum within the vacuum chamber. An ion pump by itself may not be sufficient to pump down a mass spectrometer from atmospheric pressure, so a valved port can be provided for rough-pumping the chamber to a point at which the ion pump can start. This port can be mounted on the same flange as the electrical feedthrough and inlet.

3.2 Mass Analyzer Design

The resolution of the mass spectrometer may depend heavily on the design of the mass analyzer. Generally speaking, the stronger the magnetic field, the smaller the radius of curvature. In one example, the mass analyzer in the mass spectrometer is a 180° magnetic sector, with an ion flight centerline radius of 23 mm. This is in part a practical consideration; 50 mm×25 mm NdFeB magnets are available without requiring custom fabrication, and some clearance between the ion flight radius and the edge of the magnet accommodates any imperfections in the ion's nominally circular flight due to nonlinearities of the magnet's field.

Choosing the sector length to be 180° makes it possible to increase the spatial separation between ion beams of adjacent mass, as more of each ion's flight is within the sector. Second, with a 180° sector, both the ion source and the detector are located on the same side of the mass analyzer, leading to a more compact design and fewer complications (if any) with locating the magnet yoke. Larger instruments typically don't enjoy this benefit because they have separate vacuum compartments for the ion source and detector and because the sector length in these instruments is typically limited by the size of the magnet.

There is a tradeoff between field strength and weight and cost. The maximum magnetic field strength using permanent magnets is in the range of 0.5 to 1 T, using high grade (N52) neodymium-iron-boron magnets. Higher fields require more coercive force: more magnet thickness in the direction parallel to the gap, and more iron in the magnet's return path. This can lead to a heavier and larger design. But a stronger magnetic field, e.g., created with a vanadium permandur yoke or a Hallbach array of neodymium-iron-boron magnets, increases the resolution at low masses, while the achievable higher voltages preserve the upper, light mass resolution.

Likewise there is a tradeoff between resolution and signal strength and cost. Narrowing the filter slits leads to higher resolution, but fewer ions complete the flight, causing detector gain and sensitivity to become more important. Furthermore, as the slit becomes narrower, alignment of the slit with the axis of the ion beam becomes more critical, leading to tighter tolerances and larger cost.

One illustrative design eliminates the need for filter fixturing and alignment by co-fabricating slits 160 with the chassis of the analyzer. Furthermore, the slits 160 are themselves mounted on flexures integral to the analyzer chassis such that the geometry may be varied at assembly; the slit width can be modified to change the operating point on the signal/resolution curve. In some cases, an actuator, such as a lead screw, piezo, or shape memory alloy component, changes the slit width actively, e.g., in response to feedback during calibration, operation, or both.

Figure 1D:
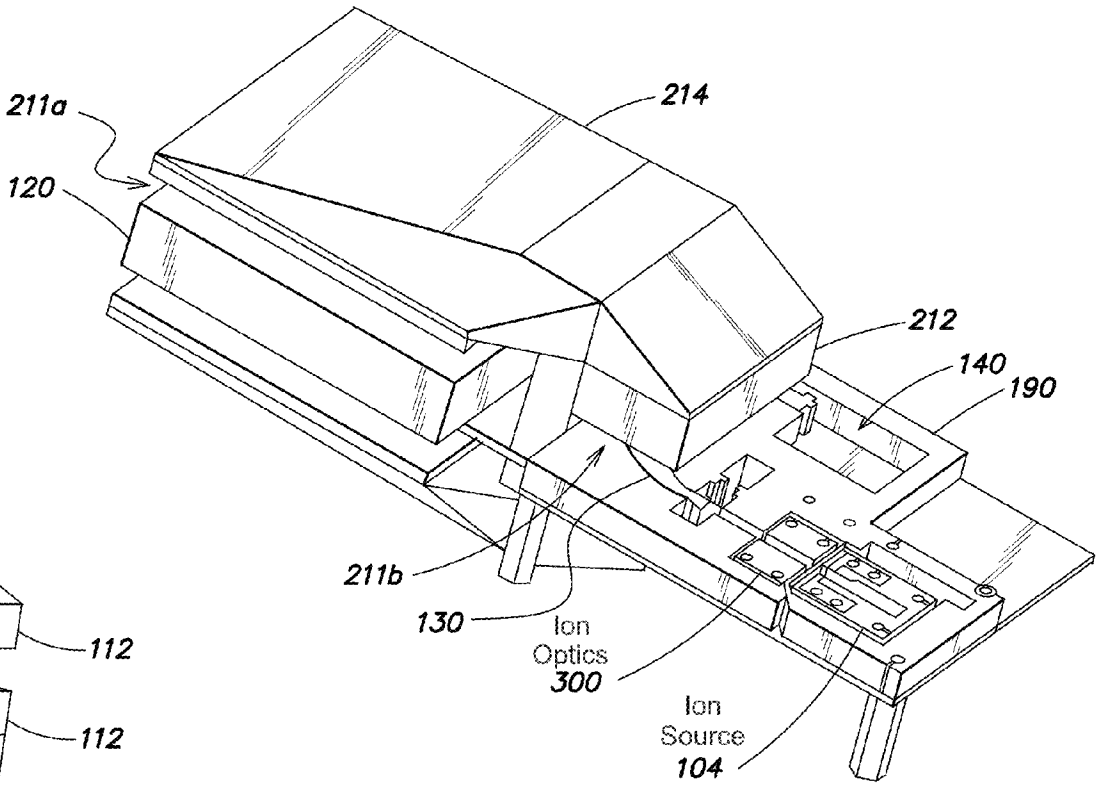
FIG. 1D shows a computer-aided design (CAD) model of a magnet yoke in combination with a pair of permanent magnets, an ion pump, and a mass analyzer, according to another embodiment of the present invention.
Figure 1C:
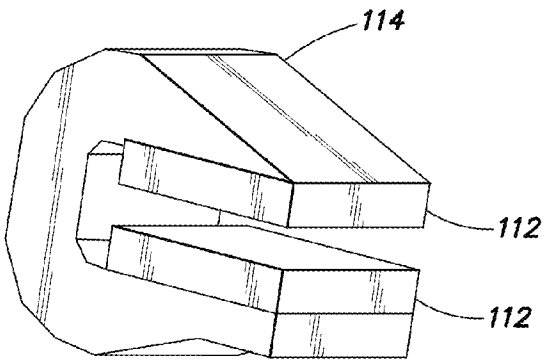
FIG. 1C shows a CAD model of the magnet yoke of FIG. 1A, according to an embodiment of the present invention.

FIG. 1C shows a computer-aided design (CAD) model of the magnet yoke 114 of FIG. 1A. It can be made of 1008 mild steel, and holds a pair of 50×50×10 mm N52 neodymium-iron-boron magnets 112 in the magnetic-sector mass analyzer 130. In one embodiment, the yoke 114 increases in cross section from the leading edge of each magnet 112 to 25×50 mm at the trailing edge of each magnet 112. The yoke mass, including the magnets 112, is approximately 1.4 kg. The yoke 114 also incorporates features for mounting; a pair of holes in the return path allows the magnet, itself the heaviest part of the mass spectrometer, to be bolted to the vacuum flange.

As shown in FIG. 1C, the cross section of the yoke 114 may be approximately constant beyond the magnet. A 10 mm gap is left between the trailing face of the magnet 112 and the yoke 114 to avoid shorting the magnet 112. The gap between pole faces is 10 mm, approximately the same air gap as magnet thickness. This configuration produces a field ranging from approximately 0.6 T at the edges of the pole face to about 0.8 T in the center. Non-uniformity of this field may leads to trajectory errors in the ion beam and lower resolution.

FIG. 1D shows an alternative yoke 214 suitable for holding one or more magnets 212 in position around the mass analyzer 130. The yoke 214 channels magnetic flux generated by the magnets 212 into two field regions 211*a* and 211*b* of different field strengths. The ion pump 120 is disposed within the first field region 211*a*, which may have a strength of about 0.1 T, and the mass analyzer 130 sits in the second field region 211*b*, which may have a strength of about 0.7 T.

Given the field strength and ion flight radius, it is a simple matter to calculate the range of ion energies, and therefore the ion acceleration potentials, required to run the mass spectrum sweeps. First is a force balance: in the mass analyzer, the force required to keep an ion on a circular trajectory is equal to the ion's mass multiplied by the centripetal acceleration, and is provided by the Lorentz force due to the ion's charge and the applied magnetic field, $$qvB \sin\theta = mv^2/r$$

where B is the magnetic field strength in Tesla; v is the ion velocity in m/s; θ is the angle between ion beam plane and magnetic field in radians; m is the ion mass in kg; q is the elementary charge in C; and r is the ion curvature radius in m.

The velocities give the range of voltages required to accelerate the ions. Final ion velocity, that is, the velocity of the ion as it exits the ion source into the analyzer, is proportional to the voltage E across the electrodes in the ion source, $$qE = \tfrac{1}{2} mv^2$$

These equations can be combined to give the relationship between ion mass and the potential required to accelerate the ion in order for it to reach the detector, $$E(m) = \frac{qB^2(\sin\theta)^2 r^2}{2m}$$

So there is an inverse relationship between the required electric field and the mass of the ion, as expected. Heavier ions require more kinetic energy to traverse the analyzer with the proper radius, given constant charge. Assuming each molecule is singly ionized (i.e., q=1.6e-19 C) and within the intended mass range, 10 to 44 AMU (m=1.66e-26 to 8.3e-26 kg), an analyzer radius r of 23 mm, and a perpendicular B field (θ=0) the equation can be simplified to, $$E(m) = 4.23 \times 10^{-23} \frac{B^2}{2m}.$$

For an operating point of B=0.6 T and mass range of 10-44 AMU, the voltage E to accelerate the ions should sweep from about 208 V to 915 V. These potentials are attainable, given the dielectric strength of high vacuum. Moreover, there are many methods capable of generating these voltages efficiently. Voltage generation will be discussed in a later section.

Figure 2:
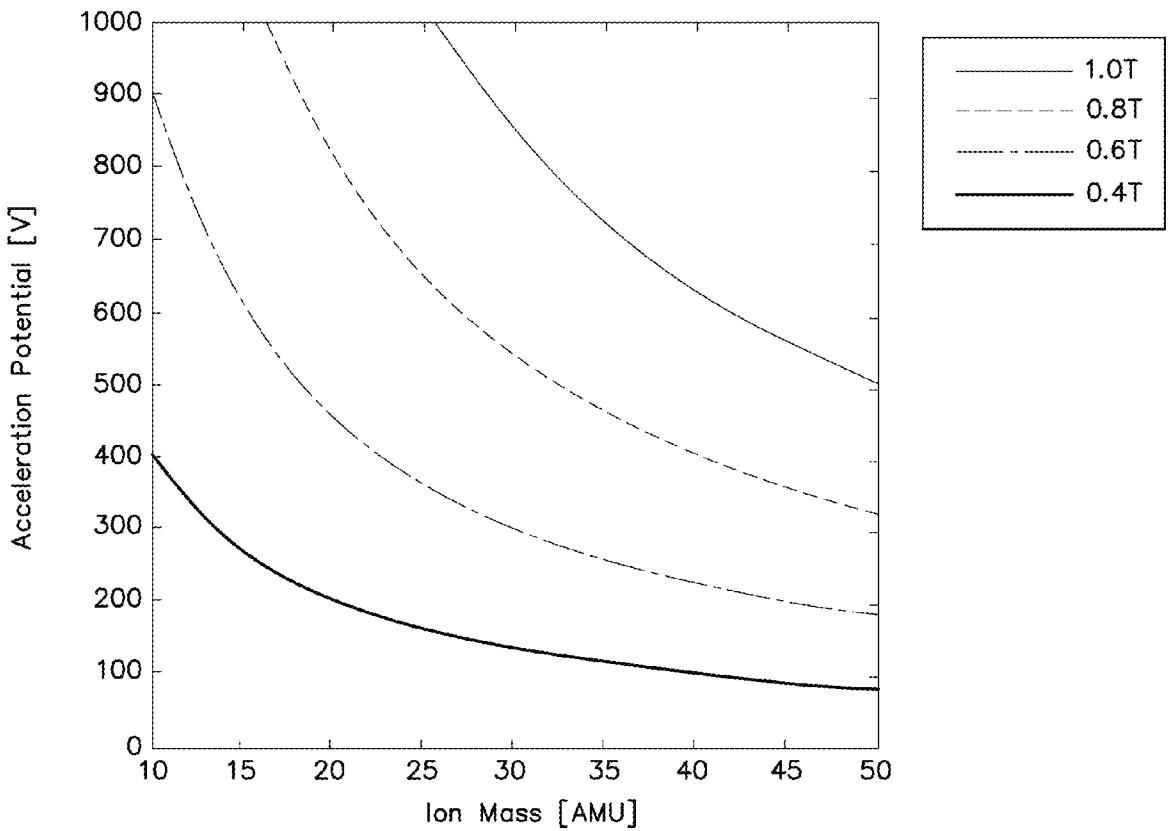
FIG. 2 is a plot of ion source potential versus ion mass for a mass spectrometer, according to an embodiment of the present invention.

FIG. 2 is a plot of ion source potential versus ion mass for different magnetic field strengths. Note that since this is an inverse power function, resolution will decrease as ion source potential decreases because the same change in ion source potential will span a much larger mass range. This is a feature intrinsic to magnetic sector mass spectrometers, and this design is no different. This issue is discussed in more detail below.

3.3 Ion Source Design

The ion source affects both the efficiency and the performance of the mass spectrometer. Ions are typically formed by electron ionization; an electron gun generates an electron beam that interacts with the sample gas to form positive ions. This type of ion source has historically been called electron impact ionization; however, due to the wavelike nature of electrons, the exact mechanism of ionization is not related to particle impact.

The ion source may be located far enough from the magnet yoke structure such that the fringing fields from the magnet do not affect the trajectory of the electrons. In some cases, the distance between the ion source and the yoke is approximately 30 mm. Furthermore, the ion source is designed with an electron beam oriented vertically, essentially in parallel with the fringing fields of the magnet. This reduces the chance that the electron beam will be sent off course by stray fields.

3.4 Electron Source Design

The electron beam is typically generated thermionically by heating a hot wire, usually tungsten or an alloy, to incandescence, so as to add enough thermal energy to some of the electrons in the wire such that they can overcome the work function of the bulk metal and escape into the surrounding vacuum. The escaped electrons are removed from the area surrounding the wire using electrostatic fields. This process of generating electrons is typically inefficient; furthermore, the probability of an interaction between an electron in the beam and a molecule in the sample gas resulting in the formation of an ion is also low, on the order of 0.1%.

Ideally, these ions emerge from the ion source in a collimated beam of appropriate geometry for subsequent flight through the analyzer. In practice, however, ionized molecules have a random distribution within the ionization region, and only a small fraction of the ions produced emerge from the ionization region in the appropriate direction to be analyzed.

To compensate, many conventional mass spectrometers employ an electrostatic field produced by an electrode, typically called the repeller, in the ionization region to sweep ions towards the analyzer; however, the field produced by this electrode is relatively low. The result is that the ion yield of a mass spectrometer using a thermionic electron gun is extremely low. Thus, a high current electron beam is desirable to increase the total production of ions, but this may require a large investment in electrical power.

There are at least three techniques by which the efficiency of the ion source may be improved. The yield of electrons for a given filament power may be increased, through the use of improved emissive materials. The yield of ions may be improved by increasing the probability of interaction between the electron beam and the sample gas, by changing the trajectories of the electron beam (e.g., a helical instead of straight trajectory). Finally, it might be possible to capture more of the ions that would form but otherwise not be swept into the analyzer. Both high efficiency emissive materials and methods of increasing ion yield were examined.

In one or more embodiments of the inventive mass spectrometers, the ion source is designed to improve ion yield. An illustrative ion source operates by ionizing a large volume of ions using a large diameter electron beam, producing an ion beam with a wide dispersion, and then using a series of electrostatic lenses to collect and collimate these ions into a uniform ion beam. A large, cylindrical electron beam is produced by a simple, low power tungsten filament and a circular aperture in an anode. This structure is called a Pierce diode and well understood; it was studied extensively in the days of vacuum tubes and appears in reference literature. The diameter of the electron beam is quite large, at 3 mm, and is used to ionize a large volume of sample gas. However, instead of directing these resultant ions through an adjacent, narrow mechanical filter, the entire volume is gathered and focused with electrostatic lenses.

In the Pierce diode, the current density of the current emitted from the anode hole is, $$J_{max} = 2.34 \times 10^4 \frac{r^2}{d^2} V^{1.5}$$

where $I_{max}$ is the current density in A/m^2; V is the voltage between anode and cathode in volts; r is the radius of anode hole in m; and d is the distance between anode and cathode in m. For a distance of d=5 mm between the filament and the entrance of the ion source and a potential of V=70 V, the emission current is 120 μA. The emission angle of the Pierce diode is θ=r/3d, where θ is the beam angle in degrees; r is the radius of anode hole in m; and d is the distance between anode and cathode in m. In one example, the Pierce diode may have a beam angle is 0.1°. The emissive material generating the electrons may be capable of producing 120 μA of electron current within a 3 mm diameter circle, which is the diameter of the hole in the anode.

The space-charge limited emission from an incandescent tungsten filament, as a function of temperature, is $$i_{max} = 60.2 \times 10^4 T^2 \exp\left(\frac{-52230}{T}\right)$$

where $i_{max}$ is emission current density in $A/m^2$ of emissive surface and T is the surface temperature in K. At 2500 K, the current density from a tungsten emitter is 3170 $A/m^2$. In one example, the ion source includes an emissive surface with an area of 4e-6 $m^2$, which is disposed in a anode hole (window) of 7.1e-6 $m^2$, that can produce a 120 to electron current. In one case, the emissive surface is formed of a tungsten filament 3 mm in length and 0.4 mm in diameter.

Alternatively, the emissive surface area can be produced using a thinner, coiled tungsten wire. The thinner wire of a coiled filament is less thermally conductive, leading to a more efficient system because less of the heat is carried out of the filament power leads, and for the same power input can be run at a higher voltage and lower current. Fifteen turns of 12 μm diameter tungsten wire, with a turn diameter of 1 mm and pitch of 0.2 mm has a surface area of 4 mm^2 and a length of 3 mm. Such a coiled filament may be supported by a support structure made of glass or ceramic insulators and copper conductors.

A filament with essentially this configuration is already mass produced as a flashlight bulb, typically designated PR-2. The PR-2 draws 0.5 A at 2.4 V, and has a coiled filament approximately 1 mm in diameter and a length of approximately 3 mm. In one example, the mass spectrometer's ion source includes a PR-2 flashlight bulb with the glass bulb carefully removed. Application of vise jaws allows the bulb to be shattered without damaging the delicate filament structure in the middle.

The electric field across the Pierce diode can be set to 70 V. As a result, the electrons emitted from the Pierce diode anode hole are at approximately 70 eV. This value of kinetic energy is a commonly accepted value for maximizing the number of ions produced by electron ionization for a given electron current. This is due to the fact that the de Broglie wavelength of an electron at 70 eV is 14 nm, which is approximately the length of the bonds between atoms in many molecules. At 70 eV, the de Broglie wavelength of the electron is given by $\lambda=h/mv$, where $\lambda$ is the de Broglie wavelength in m, h is Planck's constant, m is the particle mass in kg, and v is the particle velocity in m/s.

3.5 Ion Lenses

Figure 3:
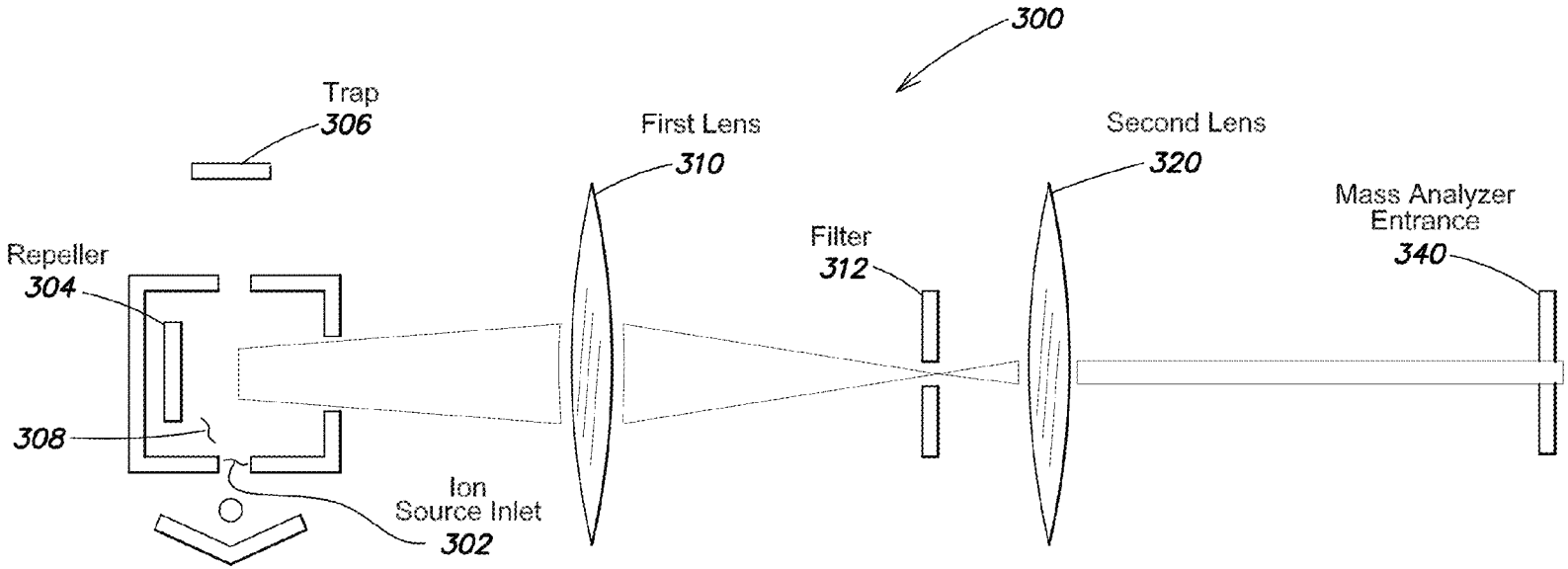
FIG. 3 is a drawing of the optics suitable for use in an ion source, according to an embodiment of the present invention.

FIG. 3 is a diagram of an ion source lens system 300 that focuses ions generated by the electron beam. The ion source lens system 300 includes an inlet 302 that admits ions into a ionization region 308 and a trap electrode 306 opposite the inlet 302. A repeller electrode 304 charged to a potential whose polarity is opposite the polarity of the ions repels the ions. The repeller electrode's weak electrostatic field sweeps the ions from the ionization region towards a three-element symmetric electrostatic lens 310, also known as an Einzel lens, that focuses the ion stream on a large slit (filter) 312. These ions diverge again beyond the filter 312, but a second two-element lens 320 defocuses the ion beam slightly, changing the focal point to a point infinitely distant from the filter 312. In other words, the first lens 310 and filter 312 spatially filter the ion beam, and the second lens 320 collimates the ion beam to make it better-suited for analysis.

3.6 Grid

Inventive ion sources include a control electrode (also called a grid) that screens the anode of the Pierce diode from the cathode. An electrical potential, or control potential, on this control electrode can enhance or prevent the emission of electrons from the cathode. The control potential, applied to an electrostatic element, may be rapidly modulated with electronics disposed inside or outside the vacuum chamber, and can operate in much the same way as a control grid in a vacuum tube. The signal used to modulate the thermionic emitter can be used with advanced signal processing techniques such as synchronous detection or stochastic system identification to improve the signal to noise ratio of the mass spectrometer.

3.7 Sample Jet

One of the unknowns is how well the electron beam interacts with the incoming sample gas. To increase the interaction between the sample gas and electron beam, a hole is provided in the center of the trap electrode. The sample is then directed downward through the trap, while electrons are beamed in the opposite direction.

3.8 Detector Design

An exemplary mass spectrometer includes a detector to sense ions in the mass analyzer. The ion beam that reaches the detector may be equivalent to a current on the order of tens to hundreds of femtoamperes (fAs). The detector at the outlet of the mass analyzer can detect these minute currents and produce a signal above its intrinsic noise floor.

In one embodiment, the detector is a Faraday cup followed by a transconductance amplifier with a gain of 50e9. The Faraday cup captures the incident ion beam as well as recapturing any electrons produced by secondary emission. Since the incident ion beam can have quite large energies, on the order of hundreds of eV, secondary emission is a concern. The Faraday cup electrode shape is designed to capture secondary emission by providing a deep cavity into which the incident ion beam travels that recaptures all electrons that are emitted in any direction but perpendicularly back out. However, since the Faraday cup is still within the fringing field produced by the permanent magnet, secondary emission electrons may be captured by the cup.

The transconductance amplifier can be built around a National Semiconductor LMP7721 low input bias operational amplifier (op-amp) or any other suitable op-amp. Operating with supplies of ±2.5 V, the LMP7721's input bias currents are on the order of 3 fA. A 50 GΩ resistor in parallel with a 5 pF silver-mica capacitor for stability provide the amplifier's feedback path. The output of this transconductance amplifier drives the front end of an analog-to-digital converter (e.g., a Texas Instruments ADS1278 24-bit analog-to-digital converter). By placing these components in close proximity and under appropriate shielding, the intrinsic noise may be reduced.

Figure 4:
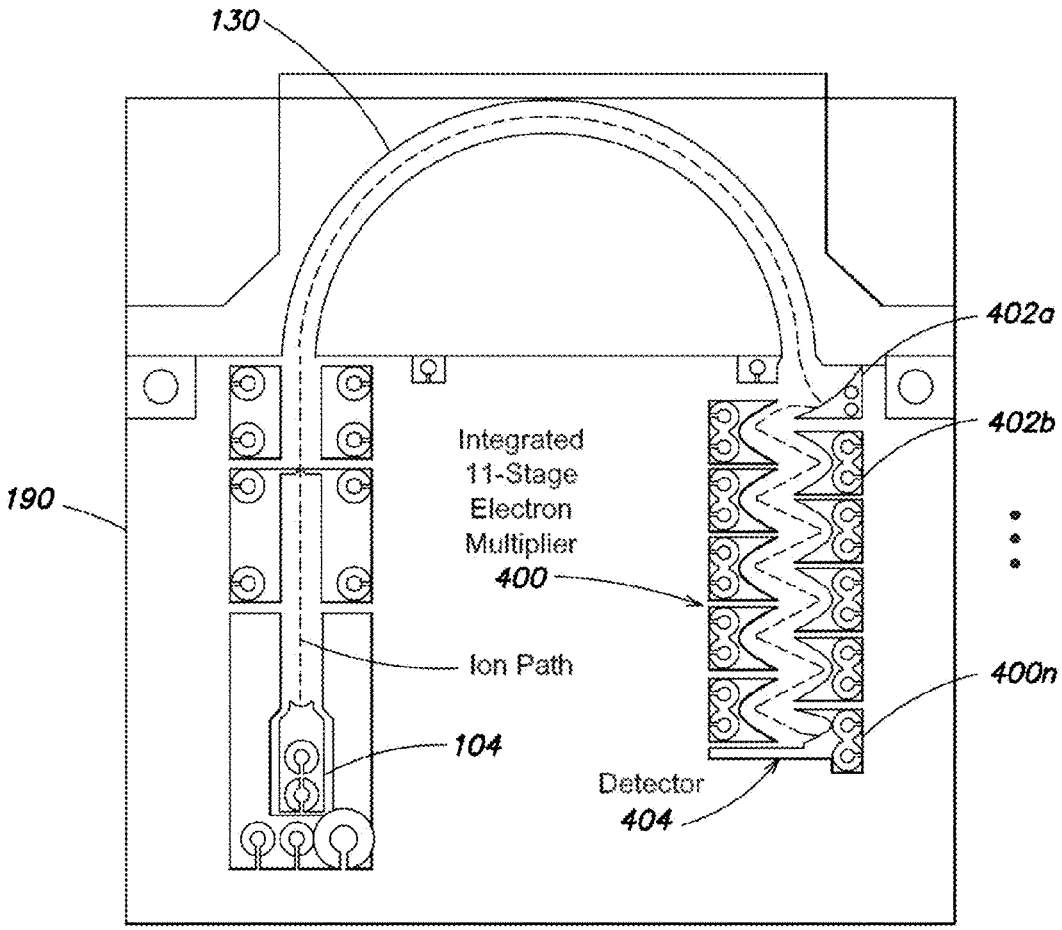
FIG. 4 is a schematic diagram of a mass spectrometer with a discrete-dynode electron multiplier and electrometer detector, according to an embodiment of the present invention.

Alternatively, the mass spectrometer may include an electron multiplier-type detector 400, shown in FIG. 4, that operates in a fashion similar to that of a photomultiplier tube without the photocathode. Ions striking a first dynode 402*a* dislodge electrons, which fall down a series of increasingly higher voltage dynodes 402*b* through 402*n*, each iteration producing twice or more the number of electrons. This electron cloud is then captured and measured by a transconductance amplifier 404, but the signal can be many orders of magnitude larger than a simple Faraday cup detector, without a significantly higher noise floor, thus allowing for much more sensitive detection. For instance, a four- or five-stage discrete-dynode electron multiplier, appropriately placed, may give a signal-to-noise ratio boost of just over 16-32, while the low dynode count reduces the dark current.

3.9 High Vacuum Pump Design

The miniature mass spectrometer uses a pump, such as an ion pump or turbo-molecular pump, to maintain the high vacuum of the vacuum envelope. Ion pumps are silent, clean, and employ no moving components. In an ion pump, two pumping mechanisms, both capture and sorption, are in operation. While pumping, gases are ionized by high field ionization in cylindrical anodes and accelerated into titanium or sometimes tantalum cathodes. Upon impact, the ions are either buried or cause titanium to sputter back to the anode. This constantly renewed layer of titanium is chemically reactive and captures gases by sorption.

The electrodes for the ion pump are located within a magnetic field, which generally adds mass to the system and complexity to the vacuum chamber. However, the miniature mass spectrometer is already designed with a magnetic circuit located within the vacuum chamber. In at least one embodiment, the size of the pole faces of the magnet are large enough to encompass the footprint of the mass analyzer and the ion pump to add pumping capability without a significant increase in complexity.

In one case, the ion pump is a diode pump, which includes a set of stainless steel hollow cylinders, open on each end, suspended between a pair of titanium plates. The pump is designed to produce the maximum pumping speed in the area available. Specific geometries and tradeoffs are discussed in below.

The ion pump keeps the system pressure low enough such that the mean free path of the ions is greater than the entire flight length of the mass spectrometer. For this miniature mass spectrometer, the length of the flight path is approximately 200 mm. The mean free path of an ion is given by, $1=3.71e\text{-}7/p$, where 1 is the mean free path length in m and p is the pressure in Pa.

In general, the vacuum should be high enough (i.e., the pressure should be low enough) to keep each ion's mean free path about an order of magnitude larger than the flight length of the mass spectrometer. For a mean free path of 2 m, the minimum system pressure is 3.3e-3 Pa (2.48e-5 torr).

3.10 Inlet

Figure 5:
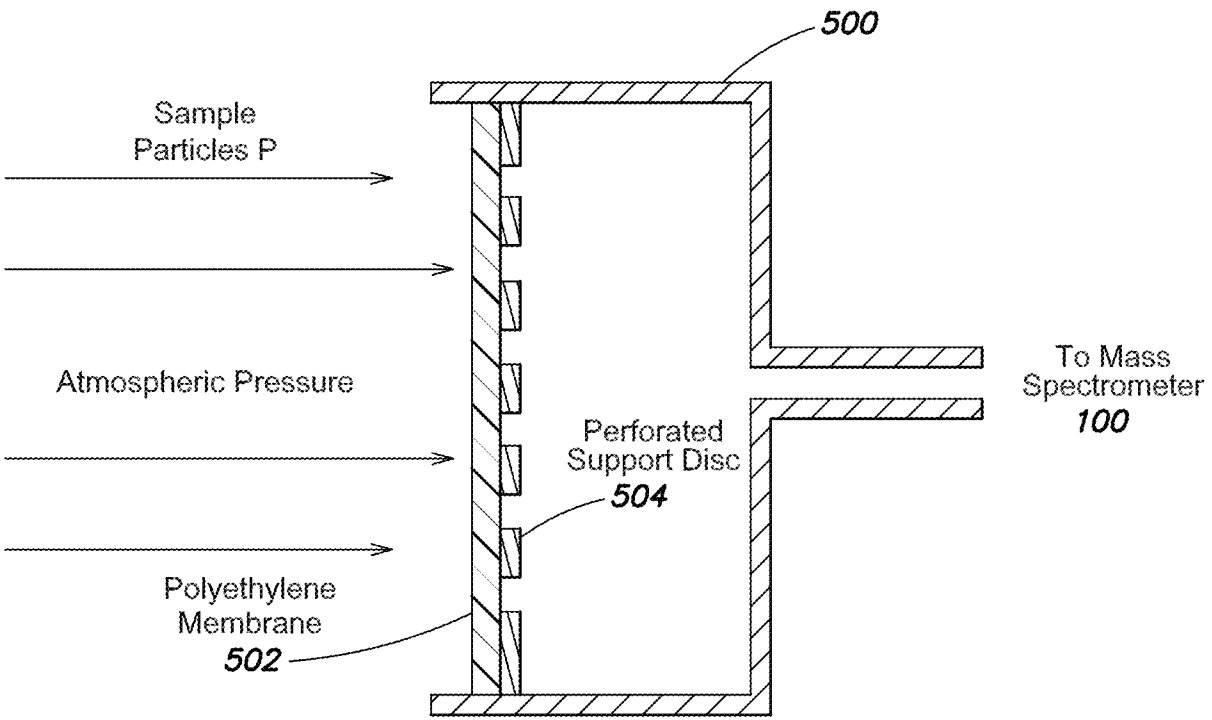
FIG. 5 is a cutaway drawing of the direct-to-atmosphere membrane inlet, according to an embodiment of the present invention.

As shown in FIG. 1A, the mass spectrometer 100 includes an inlet 180 to admit the sample to be analyzed. The inlet 180 may be of any suitable type. For instance, it may include an inlet chamber 500 formed of a semi-permeable hydrophobic plastic membrane 502 supported by a perforated stainless steel plate 504 as shown in FIG. 5. The membrane 502 allows sample particles P to diffuse into the vacuum chamber (not shown) at a rate proportional to its exposed surface area while preventing the influx of water vapor and liquids. The inlet rate can be chosen such that the mass spectrometer's pumping system can handle the inlet gas load at an appropriate vacuum chamber pressure.

4.0 SIMULATION

An exemplary miniature mass spectrometer ion optics design was extensively simulated using SIMION 8.0, a commercial ion optics modeling software package. These simulations can be used to modeling the ion flight and to make or change device parameters, including instrument geometry, magnet strength, ion radius, etc.

4.1 Dimensioning

Simulation can be used to iterate through design choices (e.g., by simulating choices that affect the electrode voltages to properly focus the ion beam). In one example of simulation, the overall height of the mass spectrometer's analyzer was set first. The vertical dimension is somewhat arbitrary. The permanent magnets used are both 10 mm in height, and the gap was chosen to match this figure. Leaving some 1.5 mm for the thickness of each of the top and bottom covers of the mass analyzer, the vertical dimension was then set to 7 mm.

Figure 6B:
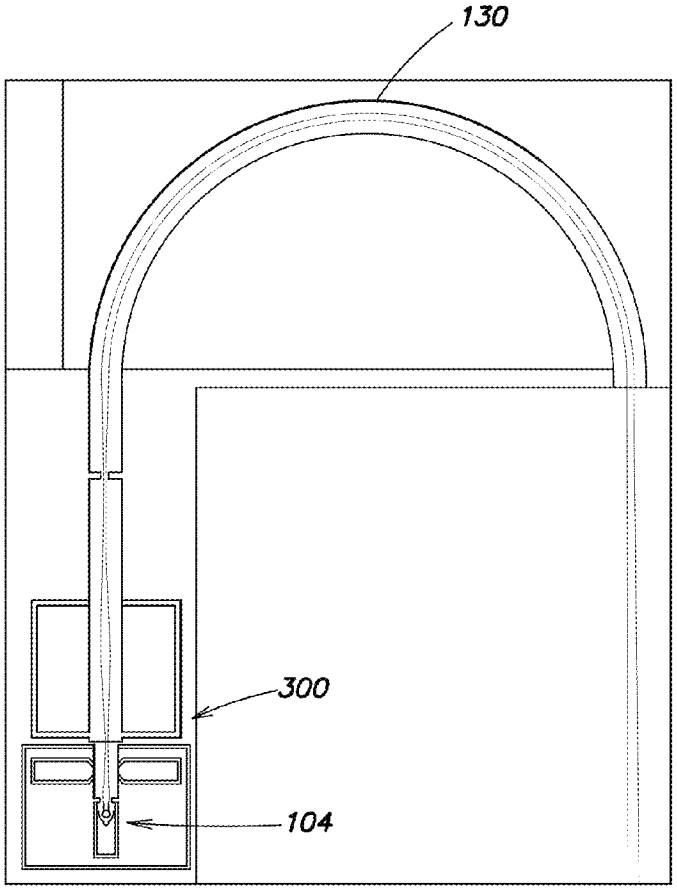
FIG. 6B is a SIMION simulation of a carbon dioxide molecules transiting the miniature mass spectrometer, according to an embodiment of the present invention.
Figure 6A:
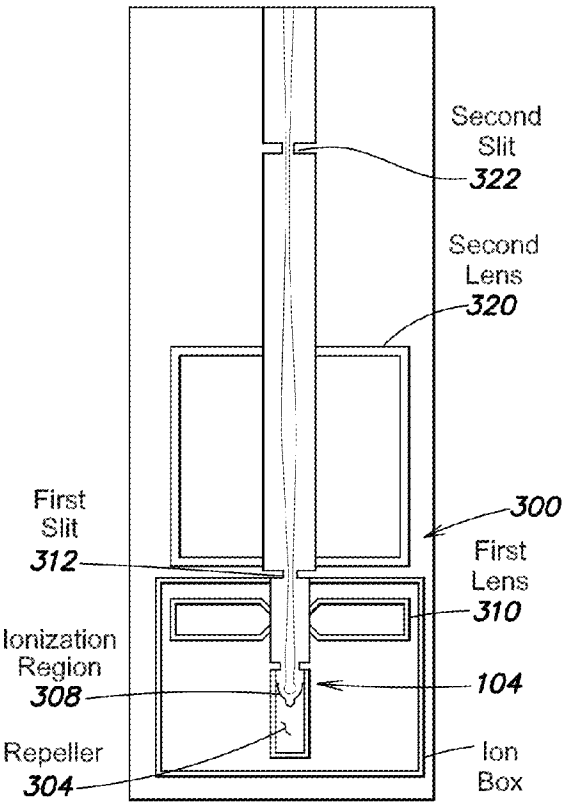
FIG. 6A is a simulation of an ion analyzer, according to an embodiment of the present invention.

FIG. 6A is a diagram of the ion source 104 (FIG. 1A) and ions source optics 300 (FIG. 3) captured from the SIMION simulation of the mass spectrometer. The radius of the mass analyzer was set to 23 mm (as above). Using this as a controlling dimension, the remainder of the mass spectrometer ion optics 300 and flight path was designed to be no more than 50 mm in length. The electron beam was placed as far from the magnetic sector mass analyzer 130 (FIG. 1A) as possible, to reduce the influence of the stray magnetic field on the operation of the electron beam.

The next decisions involved the size of the first lens 310. The first lens 310 collimates the volume of ions created by the electron beam and focuses them on a mechanical filter. This lens 310 is a three-element symmetric lens, otherwise known as an Einzel lens, and described as symmetric because the first and third lens elements are at the same potential. This type of lens was chosen because it is a variable focus lens that does not change the energy of the ion that emerges from the other side. Typically, electrostatic lenses are built with approximately the same width as element length, with an element spacing equal to a tenth of the length. Such lenses typically have focal lengths that are of equal distances on both sides of the lens; hence, the filter 312 following the first lens 310 is the same distance from the lens 310 as the ionization region.

The second lens 320, used to defocus the beam slightly (e.g., placing its focal point at infinity), is a two-element lens that roughly equally subdivides the region between the first mechanical filter and the second mechanical filter. The longer electrode faces provide a slightly more uniform field; the exact placement of the electrodes is slightly less crucial.

A second mechanical filter 322 after the second lens 320 further limits the beam dispersion to reduce stray ions reaching the detector. This filter 322 was placed 10 mm from the nominal entrance 340 to the magnetic sector mass analyzer 130 (FIG. 1A; not shown), since the fringing fields from the magnet are quite strong, and may nudge the ion beam off course before it reaches the filter 322.

Note that all of the electrodes, rather than being simple flat faces along the ion flight path, extend perpendicularly well away from the flight path. Although a flat plate would behave identically in this simulation, in practice it would be nearly impossible to fabricate. The depth of the electrodes allows them to be mounted to a common plane; the simulation is done this way as a reminder that the electrodes need to be mounted somehow. The shapes of the back sides of the electrodes are not critical.

4.2 Ion Flight Simulations

The entire mass spectrometer design was simulated and found to conform to the initial design work. Simulations were done for ions of mass 10 AMU to 44 AMU. The voltages required on the various electrodes roughly conform to the predictions.

FIG. 6B is a simulation showing the flight of carbon dioxide molecules from the ion source 104 through the ion source optics 300 and the mass analyzer 130. SIMION does not simulate either space charge, ion collisions, or secondary electron emission; the simulations are done on single, isolated ions in the geometry provided. The effects of fringing electric fields are simulated.

It is important to note that the simulation is done under ideal conditions, and one can easily be led off track by improper choice of initial conditions. For example, a simulation done on a stationary ion beginning dead center in the ion beam is likely to behave much more favorably than an ion near the edge of the ionization region with an initial velocity perpendicular to the intended path. An improper choice of initial conditions may lead to a belief that a design will work with much higher ion efficiency and resolution than the design can realistically produce. Thus, the initial conditions for ions in the flight path should be chosen carefully.

Ion initial energies were chosen to have a Gaussian spread centered around the thermal energy of a gas molecule at room temperature. The average translational energy of a gas molecule of an ideal gas is $E=3kT/2$, where E is the kinetic energy in J, k is Boltzmann's constant (8.617e-5 eV/K), and T is the temperature in K. At room temperature, E is approximately equal to 0.015 eV. Therefore, the later trajectory simulations were done using a Gaussian distribution of initial kinetic energy with a mean of 0.015 eV and a standard deviation of 0.005 eV.

Ion initial direction was set using a uniform distribution across 360 degrees radially. Ion initial position was set using a uniform distribution across a cylinder above the projection of the hole through which the electron beam enters the ionization region.

Figure 6C:
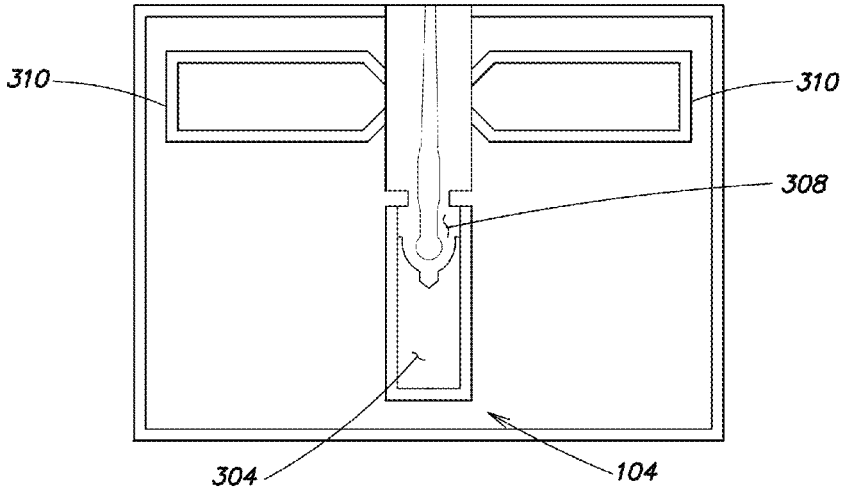
FIG. 6C is a view of the ion source and first ion lens, according to an embodiment of the present invention.

FIG. 6C is a detailed view of the ion source 104 and first lens 310 of the mass spectrometer 100 (FIG. 1A). Ions originate in the center of the ionization region 308, generated by a vertical, cylindrical electron beam, directed vertically out of the page. The initial trajectories of the ions are generated with random direction and random kinetic energy. The repeller electrode 304 directs the ions towards the first lens 310, which focuses the ions on a slit 312 (FIGS. 3, 6A, and 6B; not shown). The black traces in the simulation diagrams are computed trajectories of ions given a realistic set of initial conditions. It is reasonable to neglect space charge, due to the low magnitude of the ion current.

Figure 7:
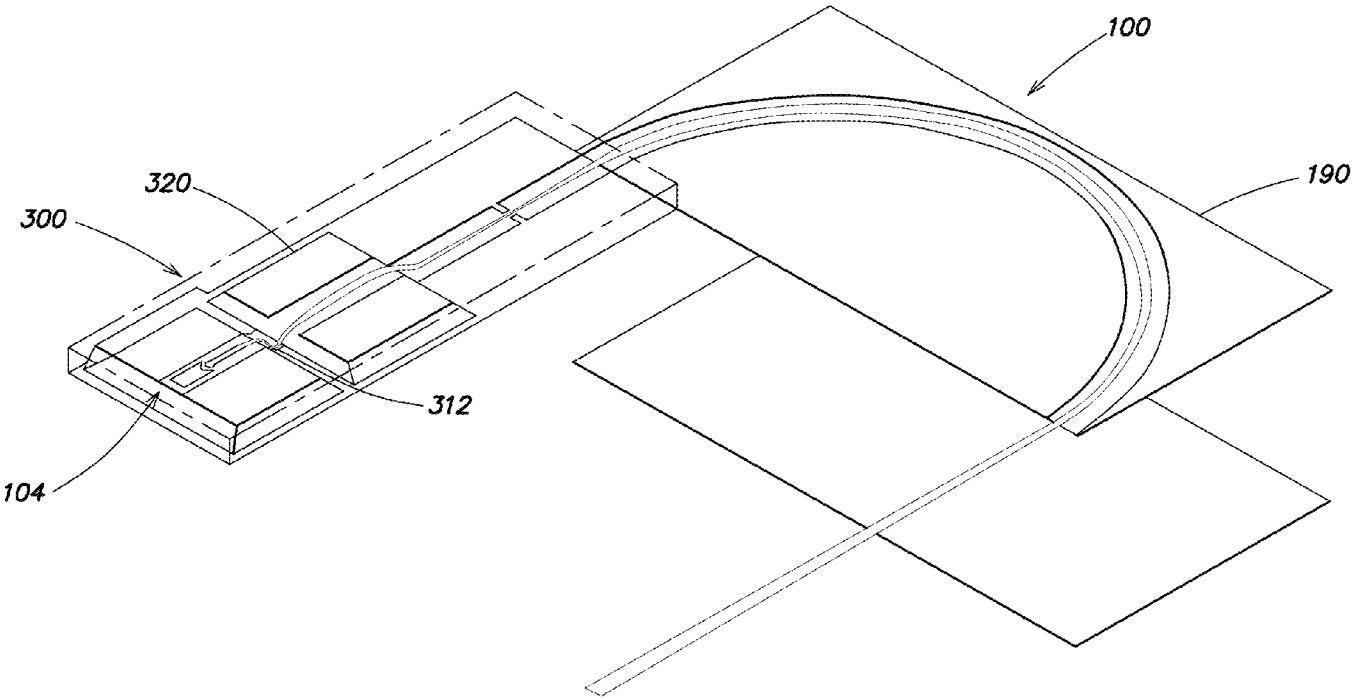
FIG. 7 is an isometric view of the potential energy distribution in the mass spectrometer ion source and analyzer, according to an embodiment of the present invention. The curvature of the green potential energy surface indicates the effect of the electrostatic lenses. The vertical dimension is potential energy, while the two horizontal dimensions are the plan form of the mass spectrometer.

FIG. 7 is an isometric view of the mass spectrometer 100, with the physical layout represented in two dimensions and potential energy represented in the third, vertical dimension. The potential energy is highest in the ion source 104, then decreases at the first filter 312, increases again in the second lens 320, before decreasing in the mass analyzer 130. Here, the benefits of a longer, lower-voltage second lens 320 becomes more apparent; any slight misalignment in a higher voltage lens could cause a much larger trajectory error in the ion beam, as the potential energy 'obstacle' the over which the beam climbs becomes much steeper.

4.3 Electron Source Simulations

Figure 9:
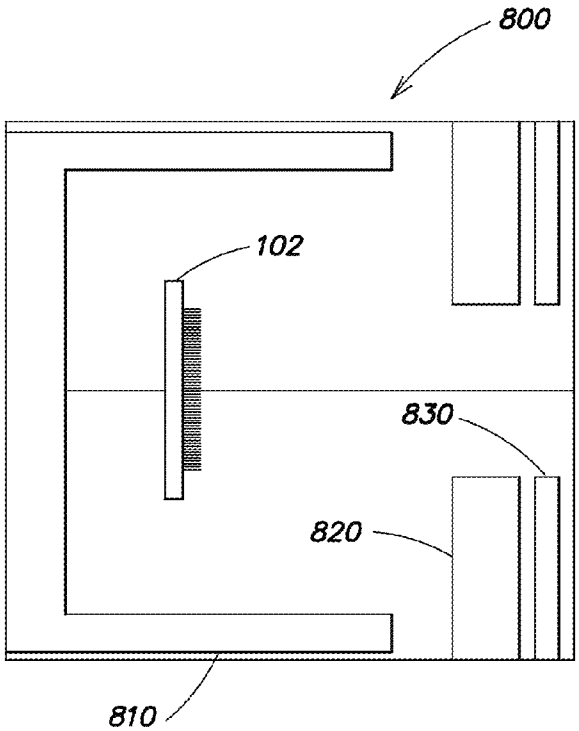
FIG. 9 is a side cutaway view of the cylindrical Pierce diode ion source of FIG. 8 with the control electrode biased such as to inhibit electron emission, according to an embodiment of the present invention.
Figure 8:
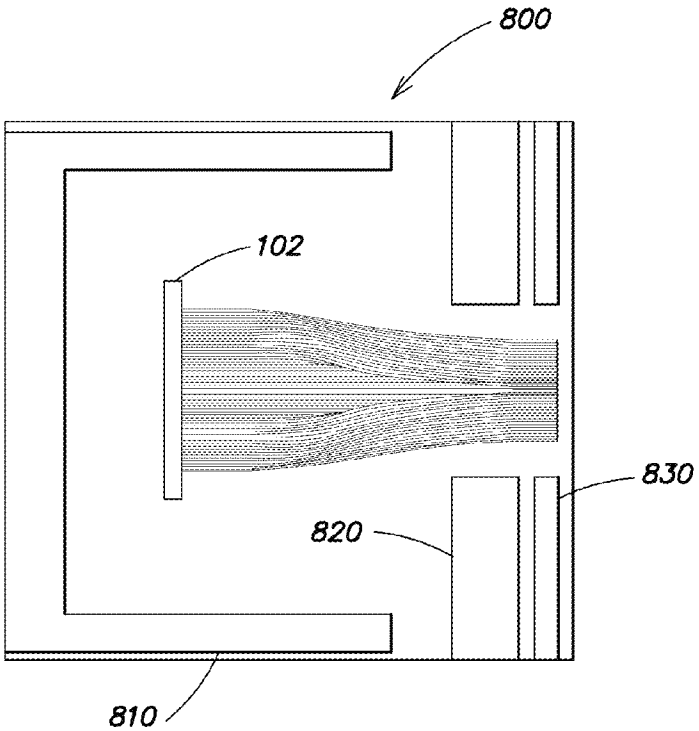
FIG. 8 is a side cutaway view of a SIMION simulation of the cylindrical Pierce diode ion source, according to an embodiment of the present invention. Electrons are emitted from the surface of a filament in a line. A cathode potential electrode surrounds the filament to screen it from the vacuum chamber. The grid and anode electrodes are shown at the right edge of the simulation.

FIGS. 8 and 9 show simulations of an electron source assembly 800, or Pierce diode, that includes an electron source 102, which may be a filament or any other suitable type of electron source. The electron source 102 is disposed with a region bounded by a cathode 810 on three sides and an anode 830 on the fourth side and is simulated here as a cylindrical source of electrons 1 mm in diameter a 3 mm in length. A control electrode 820 sits between the electron source 102 and the anode 830. Slits or apertures in the control electrode 820 and the anode 830 allow electrons to propagate to the ionization region in the ion source 104 (FIGS. 1A, 3, and 6A).

In operation, the cathode 810 is held at a potential about 70 V below the potential of the anode 830, which can be at a potential of about 100 V to about 5 kV. Control electronics (not shown), which may be disposed inside the vacuum chamber, vary the control electrode's potential from about 140 V below the anode potential to about 0 V below the anode potential. When the control electrode is off (i.e., at a potential equal to the anode potential), the cathode 810 and anode 830 act to propel electrons out of the assembly, as shown in FIG. 8. FIG. 8 shows the focusing effect of the anode; the emitted electron beam is collimated with a narrow beam angle. The electron beam narrows slightly as the source potential climbs from 150 to 900 V. Applying a voltage to the control electrode 820 reduces the intensity of the electron beam. For instance, holding the control electrode 820 at a potential 100 V below the anode potential, as shown in FIG. 9.

5.0 CONSTRUCTION 5.1 Substrate

The mass spectrometer uses a number of electrostatic elements that are held in alignment while remaining electrically isolated. To reduce parts count, a single, inexpensive substrate was chosen to maintain both alignment and isolation of all of the electrodes.

FR-4 printed circuit board material was chosen as the substrate onto which the mass spectrometer is built. The reasons for this choice are numerous. FR-4 fiberglass printed circuit boards (PCBs) are inexpensive in large quantity, due to the large number of facilities dedicated to producing custom boards and the highly automated processes involved. PCBs can be made with very small feature sizes and extremely high accuracy; typical PCB houses such as Sunstone (www.sunstone.com) can produce feature sizes down to about 0.15 mm in prototype quantities and smaller features in large production quantities, with positioning accuracy to a tenth of that. PCBs, nominally designed for electrical components, have a very high dielectric strength, on the order of 1e7 V/m to 2e7 V/m, which is sufficient for the voltages involved in this mass spectrometer design. Finally, PCBs are mechanically very strong, being primarily composed of woven fiberglass mat and epoxy resin, and are a good choice for keeping electrodes separated.

Since PCBs are designed for the implementation of electrical circuitry, both the electrodes of the mass spectrometer and the circuitry that drives it may be incorporated onto the same substrate. An additional benefit of using PCB material for a substrate is that multiple variants of printed circuit board composition exist, including ceramic printed circuit boards, and the underlying material could be changed relatively easily should the potential drawbacks of FR-4 prevent the design from working properly.

PCBs do have a couple of potential drawbacks, however. FR-4 printed circuit boards are made of copper over glass-reinforced epoxy sheets. As such, the substrate material has the potential to absorb and adsorb water and gases (diffusion into the bulk material and adhesion to the surface, respectively). These absorbed and adsorbed molecules could then be released slowly into the mass spectrometer's vacuum system, preventing the system pressure from falling low enough such that this background concentration of gas remains visible on top of the inlet gas spectrum. These potential problems are not without solutions. Two primary countermeasures to these problems exist; driving the absorbed and adsorbed gases off the material, or encapsulating the material in a low-outgassing conformal coating.

It is well known that raising the temperature of a material tends to aid in the removal of both absorbed and adsorbed gases in vacuum. Standard procedure when constructing vacuum tubes is to degas the tube by heating the elements while the tube is still on the exhaust vacuum manifold. Degassing is usually done either by operating the tube's filament, which heats the tube's electrodes by radiation, or by drawing electron current, which heats the tube's anodes and other electron collecting electrodes, or by bombing the tube. Bombing involves heating electrodes by Joule heating using eddy currents induced in the electrodes by an RF coil held external to the tube envelope.

Encapsulating outgassing materials has precedent as well. Outgassing of materials is often a problem on spacecraft, especially satellites, where gases may be emitted by one surface and re-adsorbed by other critical surfaces, such as sensors. As such, conformal coatings are often tested for outgassing properties. A standard test method for determining outgassing properties exists, ASTM E595-07. One well known low-outgassing conformal coating is parylene, and parylene coating is a service offered by many job shops.

An embodiment of the inventive mass spectrometer may include a distributed network of resistive heaters added to the bottom of the PCB substrate. These heaters enable heat to be added at points all across the PCB simultaneously. In another embodiment, these resistive heaters are replaced or augmented by a simple network of thin traces, similar to the resistive array on the rear windows of most automobiles.

5.2 PCB Design and Construction

Figure 10:
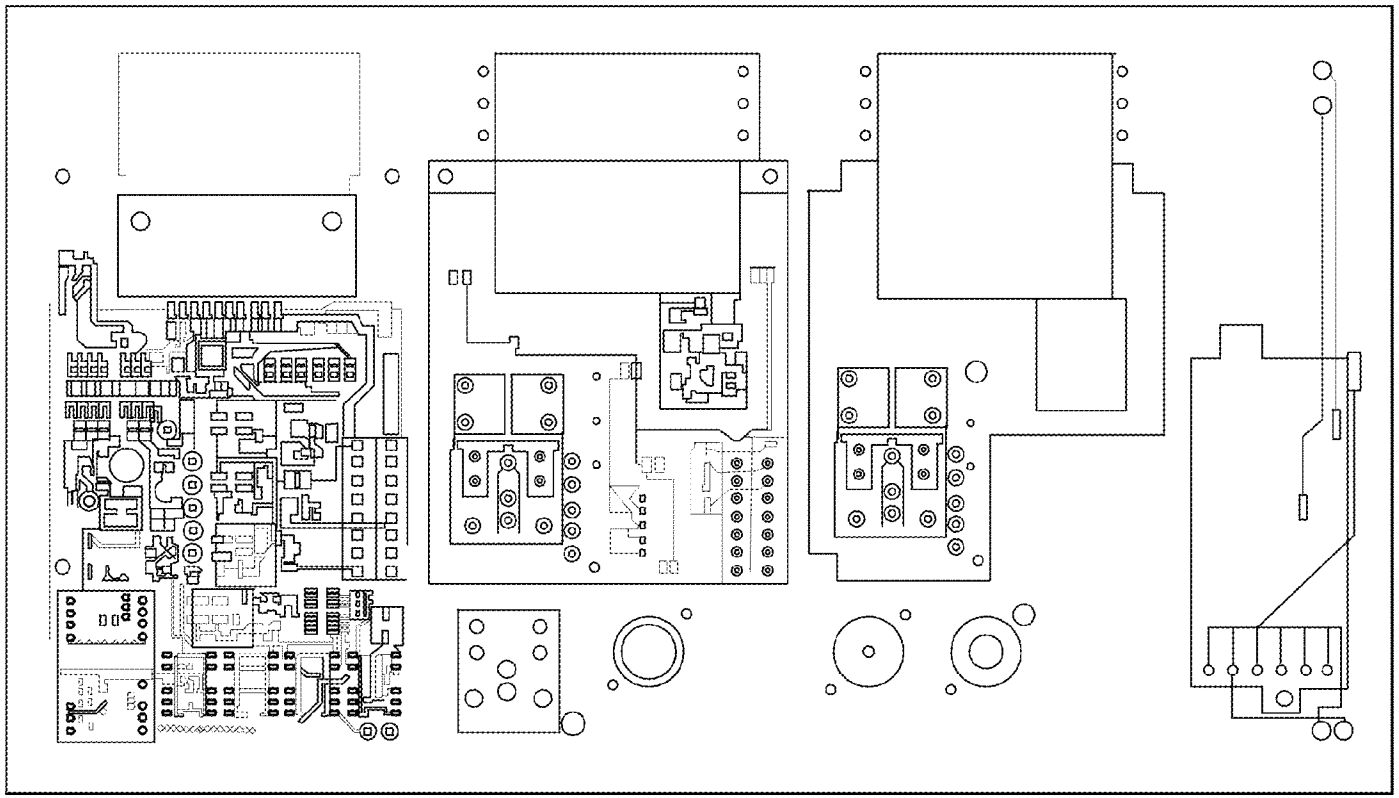
FIG. 10 is a CAD layout of the printed circuit board substrate that underlies the mass spectrometer, according to an embodiment of the present invention.

FIG. 10 shows a CAD layout of the printed circuit board, with all of the pieces concatenated (to be cut apart after build to reduce cost). To reduce the overall size of the mass spectrometer, several layers of PCB were used. A bottom layer of printed circuit board carries the electronics package, described in detail in the next chapter, while the two upper PCBs form the bottom and top covers of the mass analyzer.

Figure 11:
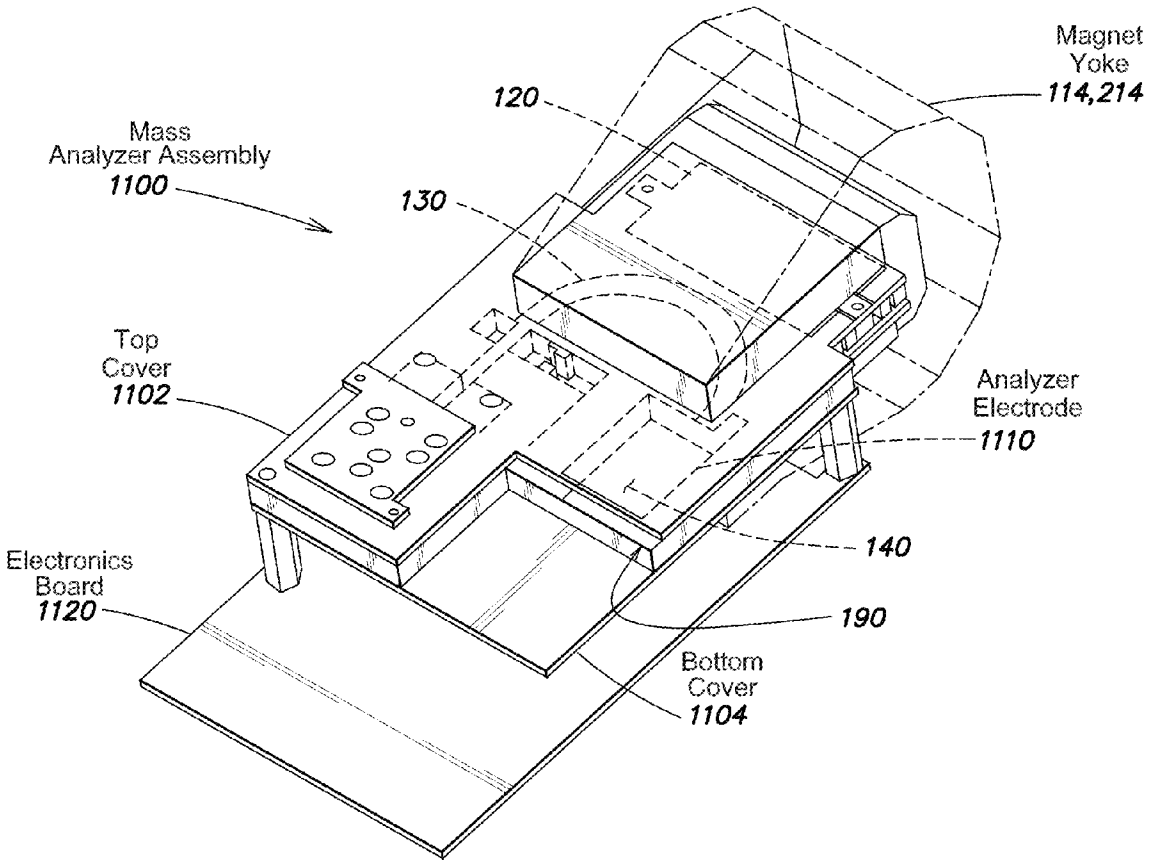
FIG. 11 is a CAD layout of an illustrative mass spectrometer, according to an embodiment of the present invention.

FIG. 11 shows a CAD model of an exemplary mass analyzer assembly 1100. The substrate 190 is sandwiched between a top cover 1102 and a bottom cover 1104, with an analyzer electrode 1110 in between. The substrate 190 is connected to an electronics board 1120 by standoffs (e.g., 20 mm long M3 hex standoffs). The screws go through the mounting holes in the analyzer ring, the mass analyzer's lower PCB, and the hex standoff. Cutouts in the mass analyzer's upper PCB allow the screw heads to seat without interference. This allows the top cover of the mass analyzer to be removed for electrode alignment without necessitating the removal of the mounting hardware.

Electrical feedthroughs connect the mass analyzer boards to the electronics boards. The low voltage digital and analog supply pins are carried on two rows of 20 mm tall, 2.54 mm spacing pin header. The high voltages used for electrostatic lenses were more difficult; electrical mezzanine connectors rated for 2 kV do not exist. Instead, a properly spaced row of holes in the mass analyzer board and the electronics board are fitted with 25 mm M2 hardware after the two boards are mechanically mounted together. The copper rings around each hole serve as electrical contacts.

5.3 Electrodes

Using PCB as a substrate, electrodes can be fabricated and fitted to the PCB. The geometries for these electrodes and their relative spacing can be taken directly from the simulations described above. The electrodes have a symmetry through the vertical axis (the axis out of the plane of the ion flight path). Most of the simple manufacturing techniques are greatly simplified when carried out in two dimensions; the fixturing or complicated machine required to mount a component to carry out operations on more than two axes adds to the cost of the finished part.

The electrodes are cut from Type 303 stainless steel. This stainless steel has multiple beneficial properties; the bulk metal and its surface oxide are electrically conductive, unreactive, and have a low affinity for gas adsorption. It is a common material used for high vacuum work; most high vacuum components are constructed of 303 stainless steel or similar materials.

Type 303 stainless steel is one of the easiest stainless steels to machine. However, some of the features required to produce these electrodes are quite small, on the order of hundreds of micrometers, and these sorts of features are not conducive to fabrication by cutting tools. Generally, the cutting tool imparts too much force for making thin walled features. Thus, the manufacturing technique chosen for fabrication of mass spectrometer electrodes is wire electrical discharge machining (wire EDM). Alternatively, symmetric components of the mass spectrometer may be built, possibly with a change of materials, as an extrusion. The extrusion could then simply be chopped into segments, leading to a very economical method of construction.

The electrodes at different potentials are separate components, but an effort was made to simplify the manufacturing for the mass spectrometer by allowing all of the electrodes that are at the same potential to be cut as one piece from the same stock. Additionally, all of the features necessary for mounting the components were designed into the tool paths so that each electrode could be cut in a single pass.

5.4 Mass Analyzer

Figure 12:
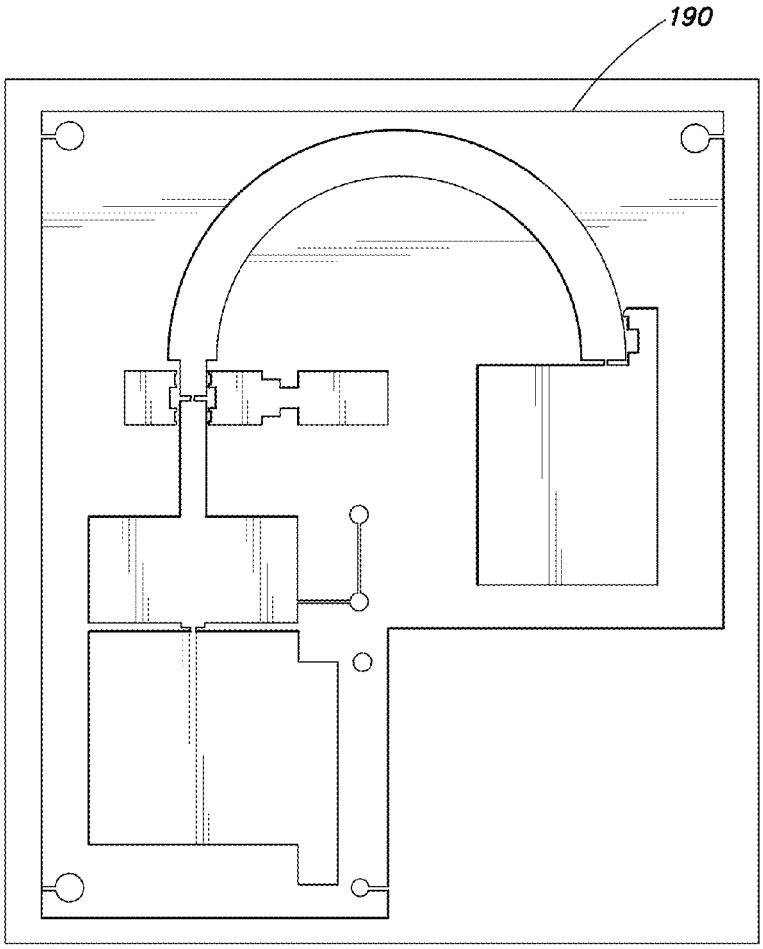
FIG. 12 is a CAD model of an exemplary mass analyzer electrode, with the slits mounted on flexures, according to an embodiment of the present invention.

FIG. 12 is a CAD model of the mass analyzer electrode. Since the mass analyzer is at ground potential, its structural loop encircles all of the other in-plane electrodes in the system for both structural rigidity of itself and of the mass spectrometer, and for electrical shielding. Fields produced by the electrodes within the mass analyzer should be shielded from the outside, thus theoretically preventing some stray fields that might otherwise interfere with the electronics.

The mass analyzer also has a pair of delicate features at the entrance and exit of the magnetic sector. These features are the mechanical filters that limit the width of the detected ion beam, maximizing the likelihood that a detected ion is of the intended mass. The filters are slits that are tens to hundreds of μm wide, and as seen from the simulations, have a direct bearing on the sensitivity and resolution of the mass spectrometer. Generally, the slits are manufactured and installed separately in most mass spectrometers; here, they are co-fabricated with the mass analyzer, both ensuring that they are collinear with the ion optics and minimizing costs by minimizing parts count and eliminating any need for slit alignment.

Figure 13:
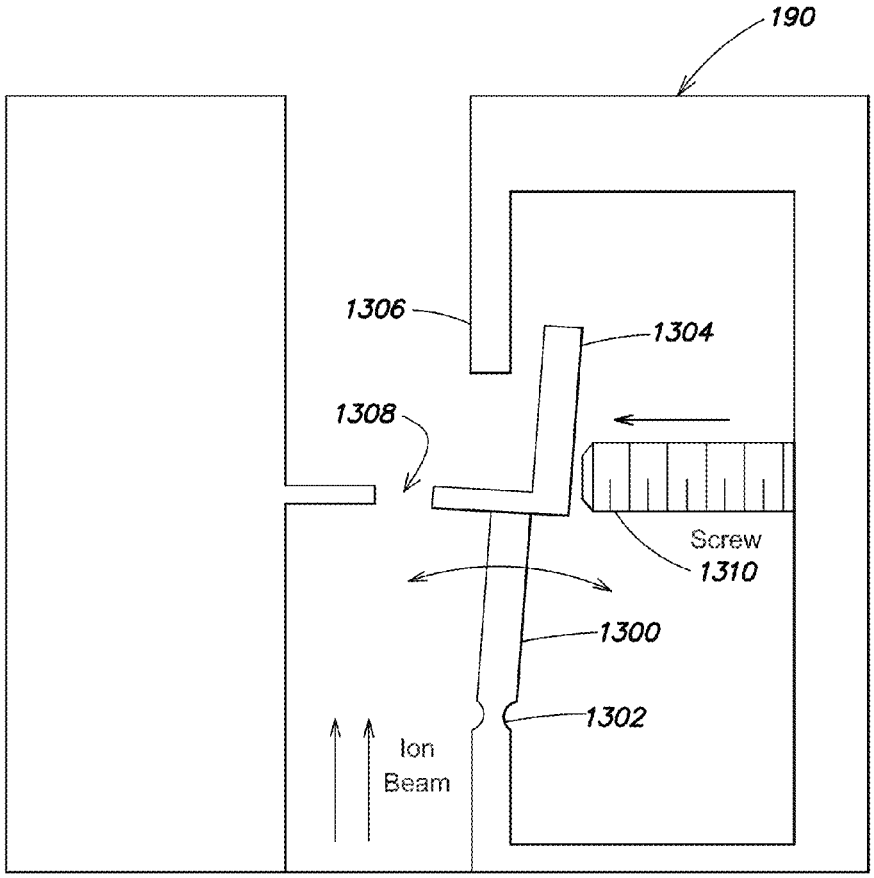
FIG. 13 is a schematic illustration of an adjustable flexure, according to an embodiment of the present invention.

FIG. 13 illustrates a thin-walled adjustable flexure 1300 formed using wire EDM from the same piece of material (e.g., PCB material) as the substrate 190 (FIG. 1A). The flexure 1300 includes an L-shaped member 1304 connected to the substrate 190 via a hinged portion (hinge) 1302. Pushing the upright portion of the L-shaped member 1304 with an actuator, such as a lead screw 1310, causes the L-shaped member 1304 to rotate about the axis of the hinge 1302, which in turn reduces the width of a slit 1308 in the ion (or electron) path. A stop 1306 prevents the L-shaped member 1304 from closing down slit 1308 too much. Unscrewing the lead screw 1310 causes the hinge 1302 to return to a relaxed position with the L-shaped member 1304 no longer closing the slit 1308. This flexure can be positioned before or during operation to give tremendous control over the resolution and sensitivity of the instrument.

In another embodiment, the flexures are actuated, e.g., by motorized lead screws or by piezo actuators. This allows the mass spectrometer to automatically optimize its sensitivity to resolution on the fly, expanding the slits to increase ion current for weak signals and narrowing them for better resolution when analyzing ions of adjacent mass.

5.6 Electrostatic Lens Electrodes

The smaller electrodes used in the ion source, mass analyzer, and detector can also cut from the same stock as the mass analyzer using wire EDM. In addition to the active faces, at least two mounting features can be cut into each electrode, corresponding to features in the mass analyzer PCB, thus minimizing the chance of angular misalignment.

5.7 Electron Beam Electrodes

The electron beam in the mass spectrometer's ion source requires electrodes for proper function as well, and these electrodes are out of the plane of the ion source electrodes. Since the electron beam runs perpendicularly to the ion beam, from bottom to top, the ion source electrodes may be fabricated using a different fabrication technique. For instance, the electron beam electrodes, the trap and the electron focusing ring, can be printed on small PCBs and mounted to the main PCBs with M2 hardware.

The electron focusing ring doubles as the physical mounting for the PR-2 flashlight bulb that provides the tungsten filament; the focusing ring allows the filament and its supports to penetrate the electronics PCB while keeping the bulb's mounting flange captive. M2 screws 25 mm in length run through the focusing ring PCB, past the flashlight bulb base and through the electronics PCB. The M2 screws are kept under tension, which fixes the flashlight bulb in place while allowing for alignment; the bulb base can be moved slightly before the mounting screws are tightened.

The trap electrode is mounted above the upper mass analyzer PCB, spaced 200 um distant by M2 washers, and through-bolted to the mass analyzer. A long M2 screw, constructed of a 30 mm length of M2 threaded rod and jam nuts, electrically connects the trap electrode to the electronics board where the trap potential is generated.

5.8 Electrode Finishing

The electrodes of the miniature mass spectrometer fit to the printed circuit board substrate like standard electrical components. For example, they can be mounted by cutting notches in each electrode and brazing small stainless steel pins to the electrode body using a hydrogen flame torch and silver solder. This approach allows the electrodes to be mounted with no protrusions above the top of the electrode, so that there was no issue of aligning the mounting features of each electrode with the mass analyzer's top PCB cover. Alternatively, the upper PCB cover may include cutouts to provide clearance for mounting screw heads. The finished version of the mass spectrometer uses a combination of M2 and M1.6 hardware to affix each electrode to the PCB.

Figure 14:
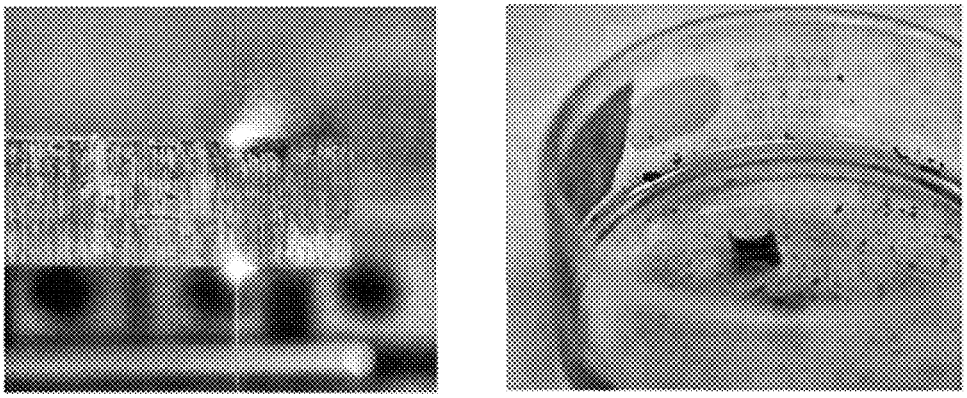
FIG. 14 includes photographs of electrodes being cut from stainless steel plate by wire EDM (left) and electrodes being etched in nitric acid to remove the oxide layer (left), according to an embodiment of the present invention.

FIG. 14 shows two steps from the process of assembling the mass spectrometer electrodes. Upon removal from the wire EDM (at left in FIG. 14), the cut surfaces of each electrode are covered with a thick oxide layer. Electrodes were bathed in a 30% nitric acid solution for 30 minutes, followed by two changes of anhydrous ethanol for 30 minutes at 50 degrees Celsius in an ultrasonic cleaning bath (at right in FIG. 14). This procedure removes the oxide layer, leaving bright metal beneath.

5.9 Magnet

In one example, the mass analyzer includes a pair of NdFeB magnets held in alignment by a soft iron yoke as described above. A mounting face is provided on one edge of the magnet yoke, drilled and tapped for M3 hardware. This mounting face can be attached to the electronics PCB.

5.10 Ion Pump

The co-fabricated ion pump can fit in a volume that is small enough to encompass just the unused half of the magnet face. Since ion pumps operate at high voltage, the printed circuit board is used to insulate the magnet pole faces from the ion pump electrodes. As such, the entire ion pump can fit within a 50×25×7 mm volume.

Figure 15:
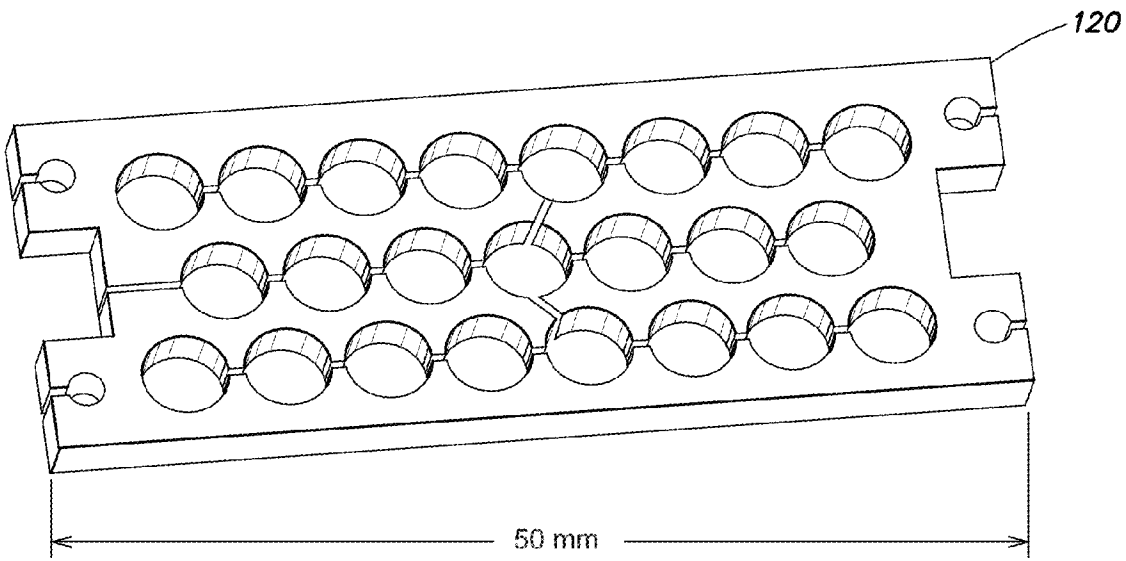
FIG. 15 is a CAD model of the anode for the miniature ion pump, according to an embodiment of the present invention.

FIG. 15 is a CAD model of the ion pump anode 120. Typically, ion pumps are designed with bunches of stainless steel tubes bonded together to form the anode. Such a process is costly and labor-intensive; the anode for the miniature ion pump on this mass spectrometer includes a series of cells cut from stainless steel plate in one pass by wire EDM.

Pumping speed is proportional both to diameter and number of cells; increasing these values, to a point, improves the speed of the ion pump. Given the limited space available, as well as the higher than standard B field strength, more cells were added instead of increasing the diameter of the cells. Another guideline indicates that the length of each cell should be on the order of 1.5 times larger than the diameter of the cell; with a 3.5 mm plate, this is difficult to do without designing extremely small cells.

The ion pump's cathode includes a pair of titanium plate cathodes, 0.5 mm thick, with mounting tabs located such that they interleave with the four mounting tabs of the anode. The mounting holes in the ion pump electrodes mate with holes in the PCB substrate.

5.11 Assembly

Figure 16:
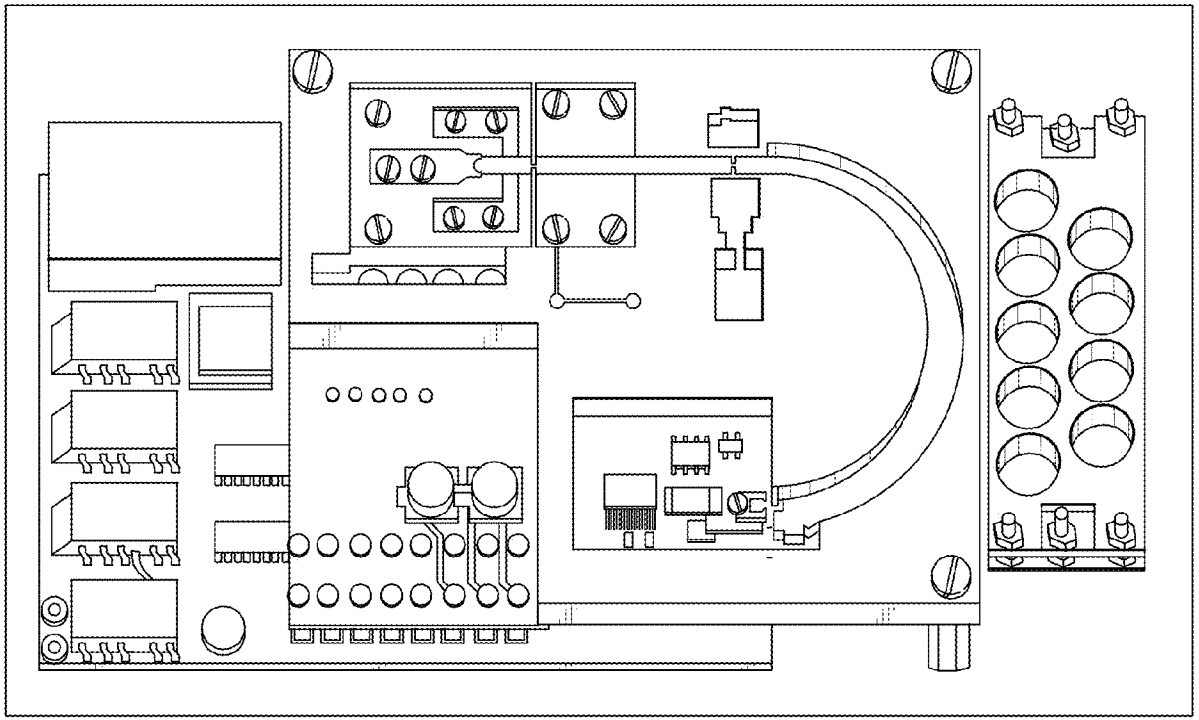
FIG. 16 is a photograph of an illustrative mass spectrometer, with top cover and magnet yoke removed, according to an embodiment of the present invention.

FIG. 16 is a photograph of the complete mass spectrometer with the top cover and magnet yoke removed. As designed, the mass spectrometer can be assembled without any complicated tools or techniques. All mounting hardware can be attached with a single 1.5 mm slotted screwdriver and long nosed pliers. Alignment features on the printed circuit board in the form of outlines of each electrode ease the assembly, and a jig can be inserted into the ion flight path upon which the electrodes can be pressed before the screws are fully tightened, ensuring that the electrode faces remain parallel. Other electrodes can be spaced with 0.5 mm shim stock, as all the electrodes were designed with a 0.5 mm gap between adjacent features.

Figure 17:
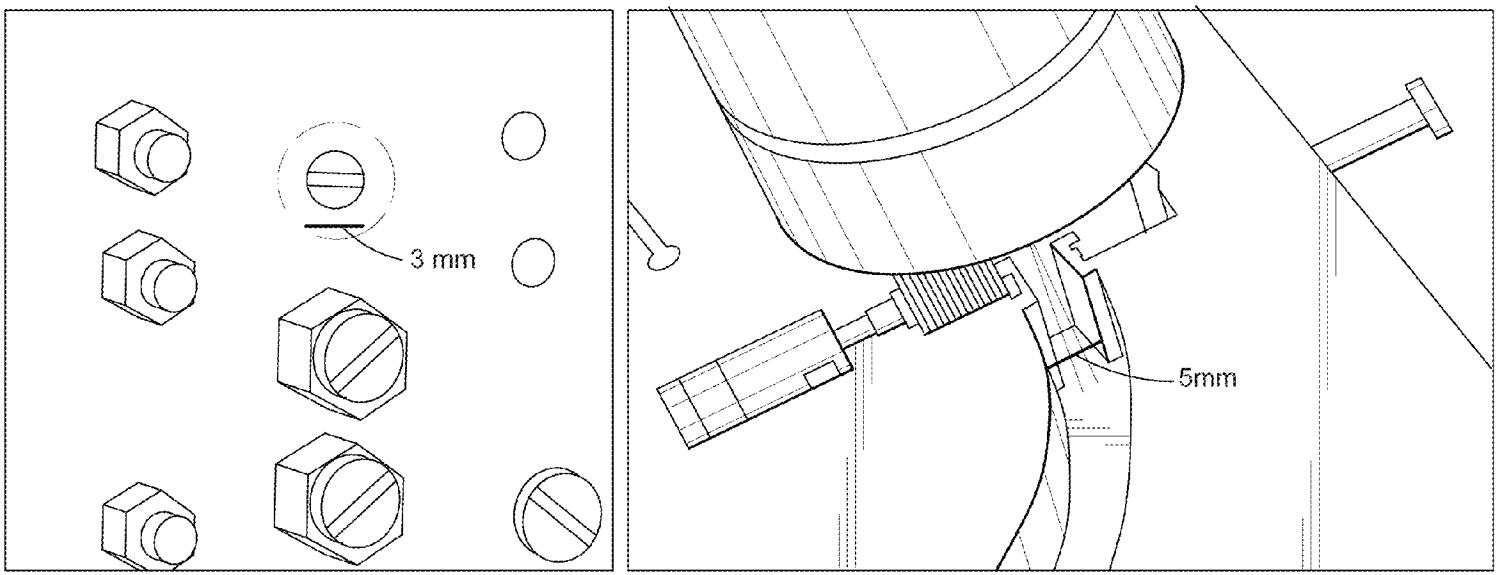
FIG. 17 is a photograph that illustrates adjustment of the entrance slit to the illustrative mass analyzer of FIG. 16, according to an embodiment of the present invention.

FIG. 17 shows a photograph of the filament (left) illuminated from the side with a flashlight and a photograph of the entrance slit (right) to the mass analyzer. Filament alignment can be done optically; a bright flashlight can be shined towards the filament from the side of the partially-assembled mass spectrometer, and the electron focusing ring electrode moved in plane until the center of the filament is clearly visible from above. Due to the large volume ion source and large diameter electron beam, this is a relatively simple procedure as visibility through the electron beam path is good. The slits on flexures that form the mechanical filters can be adjusted by tightening or loosening the lead screws. A macro photograph of the analyzer entrance slit, illuminated from above by a Mag-Lite flashlight, is shown in the right photograph in FIG. 17.

Once the electrodes are assembled, the mass analyzer's top cover can be fitted and through-bolted with a single M2 screw. The trap electrode is then fitted above the analyzer cover and through-bolted as well. The PCB assembly is then bolted to the magnet yoke; alignment diagrams indicating the relative positions of the magnet poles are etched in the printed circuit board copper layers on the outer sides of the analyzer PCB assembly. Slightly oversized mounting holes allow the magnet to be adjusted slightly to match the diagrams on the outside, thereby ensuring alignment with the now-covered mass analyzer.

Figure 18A:
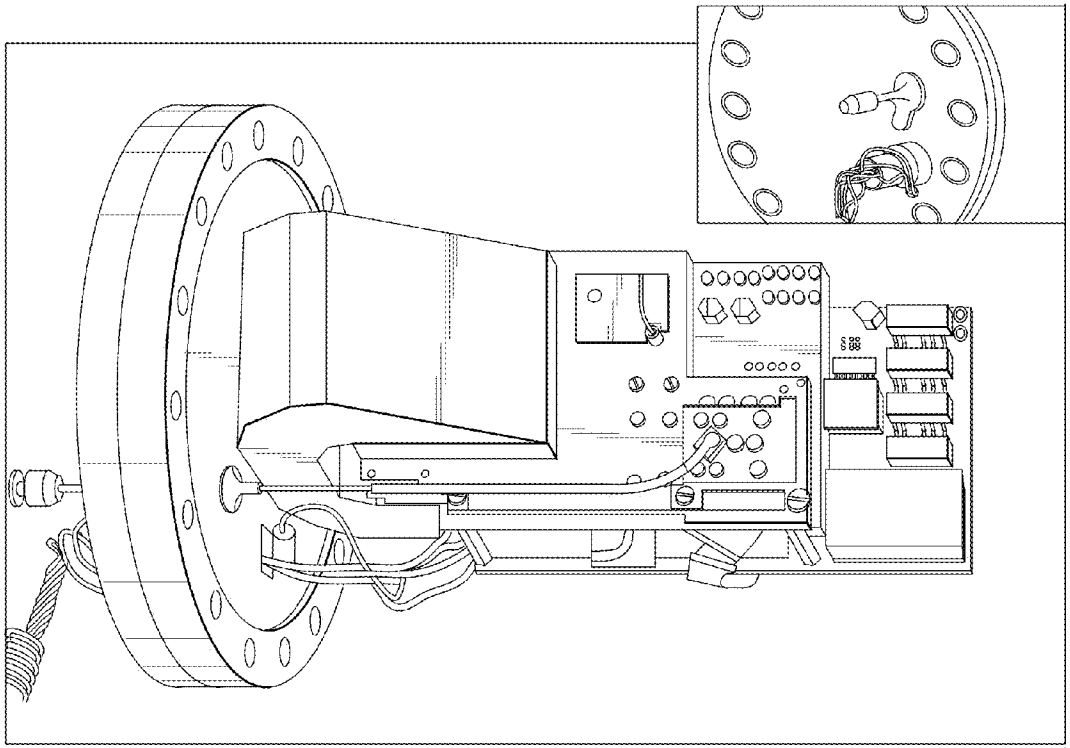
FIG. 18A is a photograph of the assembled mass spectrometer, attached to the ConFlat flange used for testing, according to an embodiment of the present invention.

FIG. 18A is a photograph of the assembled mass spectrometer attached to a 6" ConFlat flange. The final assembly of the mass spectrometer involves the vacuum chamber, which may be as simple as a steel or glass cylinder. The mass spectrometer's magnet yoke was through-bolted to tapped holes in the ConFlat flange. A piece of 1.29 mm outer diameter stainless steel hypodermic tubing for an inlet and a few low voltage wires were fed through holes in the flange and epoxied in place. The inset photograph is the side of the vacuum flange opposite the mass spectrometer, showing the electrical and gas connections to the instrument. (A port for a roughing pump could be used on this flange; in this case, however, the roughing port was provided on another end of the vacuum chamber.)

Figure 18B:
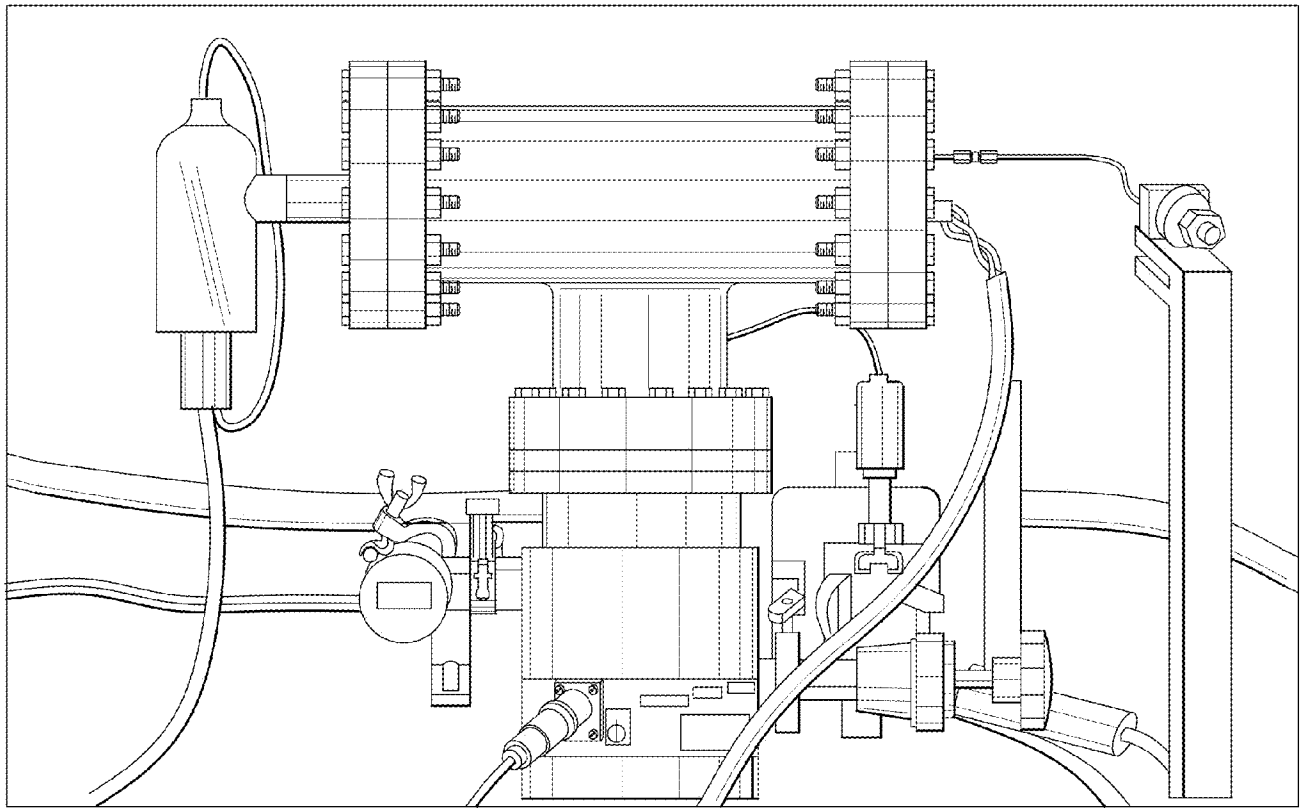
FIG. 18B is a of the vacuum chamber used in the development of the mass spectrometer, according to an embodiment of the present invention. The ion gauge is on the left and the turbopump at the bottom.

FIG. 18B is a photograph of the mass spectrometer mounted on the flange and inserted into the end of a 6" ConFlat tee. The far face of the tee was fitted with an ion gauge (Duniway Stockroom, www.duniway.com) connected to an ion gauge controller (Varian model 843, www.varian-inc.com/vacuum). The third face of the tee was used for the roughing system.

As the initial gas load from this mass spectrometer was expected to be rather high, a powerful roughing system was used. A 0.2 m^3/s turbo-molecular pump (Varian V-200) was connected to the ConFlat tee, and the turbopump's exhaust connected to a mechanical roughing pump (Welch Vacuum 1402) and cooling provided by a temperature controlled recirculator (VWR Scientific Products) with distilled water as the working fluid.

6.0 ELECTRONICS

The electronics that control the miniature mass spectrometer, aside from the detector, sit on a printed circuit board beneath the mass analyzer board. As with the mass analyzer, the electronics board is fabricated without a solder mask to facilitate outgassing. Physically, the electronics board is laid out such that 20 mm M3 standoffs can be used to mate it to holes in the analyzer board, and electrical feedthroughs connect the electronics board to the electrostatic elements and detector on the mass analyzer board. The electronics board includes two major sections: a power supply section (conversion circuit) and a digital controller. Multiple independent, isolated power supplies operate all of the subsections of the electronics board.

6.1 Power Supplies (Conversion Circuits)

The mass spectrometer may operate at a single input supply of +12 VDC, at up to 1.1 A, although typical supply current while operating under normal conditions is 0.5 A. Multiple different supplies are generated internally via one or more dc/dc converters (conversion circuits 150 in FIG. 1A). The +12 V supply also serves as the main supply for the lens drivers, as detailed in a section below. The ground of this supply serves as the system ground and is also tied to the vacuum envelope.

In one example, the conversion circuit generates voltages for the various spectrometer electrodes and components, including but not limited to: the microprocessor, the digital-to-analog converters (DACs), and the analog-to-digital converters (ADCs) that are used to control the mass spectrometer; the analog stages of the detector 140 (FIG. 1A); the electron source and electron source electrodes (e.g., the filament 102, cathode 810, control electrode 820, and anode 830 in FIGS. 8 and 9); the ion pump 120 (FIG. 1A); ion optics 300 (FIG. 3); and ion source 104 electrodes, such as the repeller 304 (FIGS. 3 and 6A). Suitable voltages include digital logic voltages (e.g., +3.3 V, +5 V) and potentials of about 100 V to about 5 kV for the ion pump 120, electron source, ion optics 300, and ion source 104. The spectrometer may also include filters and regulators to compensate or correct ripple in the input voltage from the external power supply.

The spectrometer may also include one conversion circuit 150 for each component and electrode or conversion circuits 150 that generate voltages for groups of components and electrodes. For instance, it may include an isolated +3.3 V/1 W dc/dc converter supplies the digital logic. The digital logic includes the microprocessor and the analog input/output (I/O) modules, such as the DACs and the ADCs that are used to control the mass spectrometer. The digital side of the detector's ADC is also run from the digital logic supply. The ground side of the logic supply is tied to the system ground at a single point.

The spectrometer may also include an isolated ±5 V/1 W dc/dc converter followed by a pair of linear regulators provides a ±2.5 VDC supply for the analog stages of the detector. This supply is heavily filtered and lightly loaded, providing supply current for a pair of op-amps and the analog half of the detector ADC. The ground of this supply is tied to the system ground right at the detector electrode to reduce noise.

The spectrometer may also include an isolated +3.3 VDC/3 W dc/dc converter provides supply voltage for the filament, which draws nominally a 2.4 V/500 mA. The ground of this supply is tied to the filament bias supply, which is in turn 70 V below the ion source supply.

The spectrometer may also include an isolated +3.3 VDC supply, with its ground biased to the trap potential, provides supply voltage for the ADC that measures the mass spectrometer's trap current. The spectrometer may also include an isolated +5.0 VDC supply, with its ground biased to the ion source potential, that provides the supply voltage for the op-amp that drives the repeller electrode 304 (FIG. 3). It may also include an isolated 3 kV/3 W dc/dc converter provides the anode voltage for the onboard ion pump 120.

6.2 Ion Optics Drivers

Five high voltage proportional dc/dc converters (conversion circuits) provide the electrostatic element potentials. A proportional dc/dc converter generates an output voltage that is linearly proportional to the converter's input voltage, and is useful when a range of output voltages is desired. The input voltage of these dc/dc converters is supplied by operational amplifiers configured such that a fraction of the output voltage of each dc/dc converter is fed back to each op-amp, stabilizing the output. The reference for each op-amp is provided by a DAC from the digital controller or from a potentiometer for potentials that can be calibrated once and may remain unchanged during operation.

These dc/dc converters (conversion circuits) supply potentials for the ion source, the ion source's electrostatic lenses, the trap, and the bias for the filament. All of these converters' outputs are referenced to system ground. Although it would have been easier to tie the outputs together appropriately (e.g., reference the trap supply to the ion source supply instead of ground), the output isolation rating of each of these dc/dc converters was not sufficient to do so.

6.3 Electrometer

The electrometer connected to the Faraday cup electrode is a sensitive transconductance amplifier, as a National Semiconductor LMP7721 operational amplifier in transconductance configuration with a gain of 5e10, connected to an analog-to-digital converter. In parallel with the feedback path is a 5 pF silver mica capacitor; the capacitor decreases the amplifier's gain at high frequency, thereby cutting down on the high frequency noise present at the amplifier's output.

Due to the electrometer's high gain, leakage currents can cause drift in the electrometer output. To help reduce this, a guard ring surrounds the junction connecting electrometer's input pin, one end of the feedback resistor and capacitor, and the Faraday cup electrode. This guard ring is driven by a second operational amplifier, such as a National Semiconductor LMP7715, in unity gain voltage mode whose input is derived from the non-inverting and nominally grounded (and slightly offset due to bias currents) input of the electrometer. The output of the transconductance amplifier is digitized directly by an ADC (e.g., a Texas Instruments ADS1281 24-bit ADC).

The entire electrometer circuit is mounted on the analyzer PCB inside a pocket cut into the mass analyzer electrode. The electrode, in conjunction with copper on the two PCBs, serve to encase the electrometer inside a Faraday cage. The close proximity of the electrometer to the Faraday cup detector electrode reduces the opportunity for noise to disrupt the signal.

6.4 Degas Heater

The printed circuit boards in the vacuum chamber were expected to carry a fairly large gas load. As such, a network of distributed resistors was added to the printed circuit boards to ensure that the board temperatures could be raised far enough to help remove the gases absorbed and adsorbed by the PCB. Multiple 1 W resistors, operated by the main +12 VDC supply, are placed in strategic locations and gated by a P-channel FET as an on/off or PWM heating control.

6.5 Digital Controller

Figure 19:
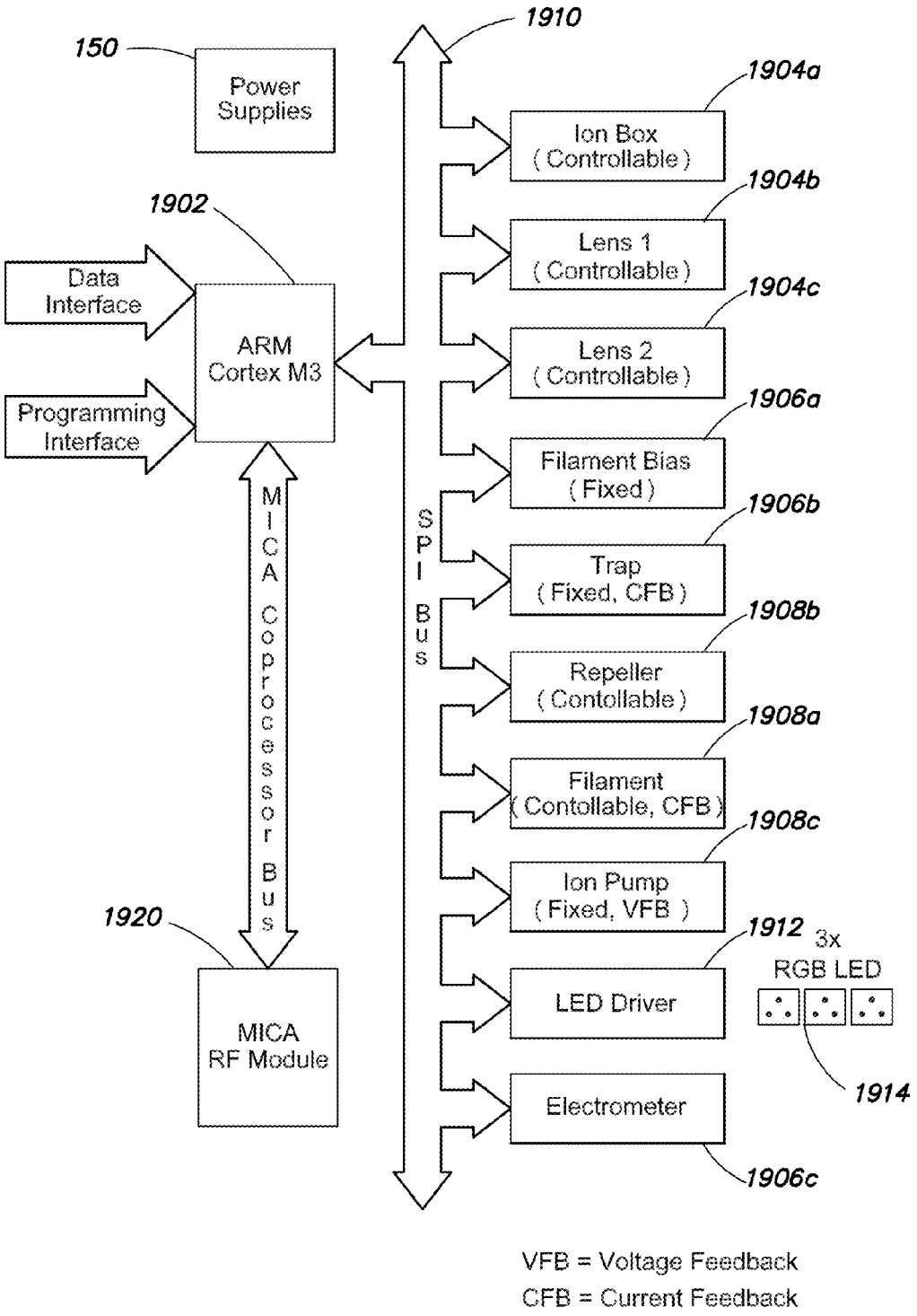
FIG. 19 is a block diagram of the digital controller for the mass spectrometer, according to an embodiment of the present invention.

FIG. 19 is a block diagram of the mass spectrometer's digital controller 1900, which is built around a processor 1902 (e.g., a 32-bit ARM Cortex-M3 microprocessor manufactured by STMicroelectronics (STM32F103CBT6)). The processor 1902 is powered by power supplies (conversion circuits) 150 and coupled to a radio-frequency (RF) communication module 1920, which acts a wireless communications interface for relaying data and instructions between the inside and outside of the vacuum chamber. The controller 1900 also includes DACs 1904*a*-1904*c* (collectively, DACs 1904), ADCs 1906*a*-1906*c* (collectively, ADCs 1906), and field-effect transistors (FETs) 1908*a*-1908*c* (collectively, FETs 1908) coupled to the processor 1902 via a common serial peripheral interface (SPI) bus 1910 on the microcontroller 1900. The entire controller 1900 may be contained within the vacuum cavity defined by the mass spectrometer's vacuum cavity. For instance, the controller 1900 may be mounted or coupled to the electronics board 1120 shown in FIG. 11.

In one exemplary controller 1900, there are three DACs 1904*a*-1904*c* (e.g., AD5662 DACs) used to set the potentials on the ion source supply and the two electrostatic lenses. There are two ADCs 1906*a* and 1906*b* (e.g., AD7680 ADCs) used to measure the filament drive current and the trap current. The two ADCs 1906*a* and 1906*b* are both operating on supplies biased at high voltage; the SPI bus for these devices is isolated from the logic-level bus by opto-isolators (e.g., Avago Technologies ACSL-6410 bidirectional (3/1 channel) opto-isolators). Another ADC 1906*c* is coupled to an electrometer.

The DACs 1904 and ADCs 1906 are connected to the microprocessor's SPI bus 1910. Each DAC 1904 and ADC 1906 has its own dedicated microprocessor GPIO pin for addressing. Additionally, several GPIO lines run to the electrometer ADC for other functions (e.g., data ready, reset). A port expander/LED driver 1912 (e.g., a Maxim Integrated Products MAX6696 port expander/LED driver) is also connected to the SPI bus 1910 and three RGB LEDs 1914, used for user feedback.

A pin connected to a hardware timer on the microprocessor 1902 is used as the gate drive for a P-channel FET 1908*a* connected to the filament. The filament is driven in a pulse-width modulated manner for maximum efficiency. Switching frequency is 100 kHz, but can be changed during operation if interference is detected.

Other pins on the processor are used to control other peripherals. Several of the power supplies, including the filament and most of the high voltage supplies, and the degas heater, are gated by large P-channel FETs (e.g., FETs 1908*b* and 1908*c*). The FETs 1908 are driven by microprocessor pins, such that the filament and high-voltage supplies can be shut down to save power when the mass spectrometer is not being used.

A pair of pins is used to control and monitor the ion pump. One pin enables the ion pump so that the controller can be run at atmospheric pressure without the ion pump arcing. The other pin is used, as an analog input connected to the microprocessor's onboard 12-bit ADC, to monitor the terminal voltage of the ion pump supply.

Two pins connected to the hardware USART transceiver in the microprocessor are the mass spectrometer's means of communication with the outside world. These pins pass through the wall of the vacuum chamber (although the data could be passed optically if the vacuum housing were made of glass).

In this example, the three serial wire programming (SWP) pins specific to the Cortex-M3 were also passed through the vacuum housing, so that the microprocessor's code could be reconfigured without requiring venting the vacuum chamber.

6.6 Control Software

In one example, the control software for the mass spectrometer is written in the computer language C and compiled for the Cortex-M3 core using the IAR Systems Embedded Workbench IDE and compiler. The main execution loop is a finite-state machine that controls the basic operations required to produce mass spectra. During each loop cycle, the mass spectrometer reads all of the available data indicating the states of the external variables and then executes code that depends on the state of the instrument. One of the LEDs is tasked with blinking a color depending on the state of the machine. The blinking speed is controlled by the main execution loop, providing visual feedback that the code has not locked up. The following sections describe the states in more detail.

6.7 Boot

At boot time, the mass spectrometer checks the state of the state of all of the peripherals attached to the buses. Most of the peripherals, the ADCs and the various power supplies, can be checked by interpreting the data they provide. Failure of any of the self checks causes the mass spectrometer to go into fault mode.

6.8 Standby

In standby mode, the microprocessor shuts down all of the peripherals except, optionally, the ion pump and degas heaters. In this minimal power consumption mode, the system may draw less than 1 W.

6.9 Idle

In idle mode, the microprocessor brings the high voltage supplies and the filament supply online. The filament is operated at reduced voltage to increase its lifespan. In this mode, the microprocessor can ensure that the high-voltage supplies are functioning properly and that the filament has not burned out. During transitions to idle mode, the filament is brought to temperature slowly to reduce thermal shock. The filament warm-up time may be about 0.5 s.

6.10 Sweep

In sweep mode, the microprocessor is actively driving the electrodes and measuring the ion currents. The ion source supply is brought to the minimum voltage achievable by the hardware, approximately 150 V, and swept through to about 800 V at about 20 V/s. The electrostatic lens voltages are also constantly changed to properly focus the ion beam at each ion source potential.

Electrometer current is sent out the serial port to a laptop or other computing device connected to the mass spectrometer. Data may be collected with a simple terminal program; when running mass scans, the data are outputted as columns of text which may be captured on the laptop and opened as a data file (e.g., a comma-separated-variable (.CSV) file) in a data analysis program.

The mass spectrometer is controlled by a serial terminal interface that is accessed via a computer. The terminal program on the mass spectrometer allows commands to be sent and interpreted, mostly for debugging purposes, but also for controlling the state of the machine. The command "mode" with an argument specifying a new state, allows the user to switch between the modes of operation as detailed above. The commands "filament," "repeller," "ionbox," "lens1," and "lens2," with an argument such as a floating point number or on/off (e.g., "filament off" or "ionbox 500.0"), allow the user to directly control the various electrodes in the vacuum chamber. Other commands, "degas," "ionpump" allow the user to turn these peripherals on and off remotely, as the microprocessor can't know when these features should be enabled or not.

7.0 TESTING

The mass spectrometer was subjected to extensive testing of both subassemblies as well as the complete system.

7.1 Power and Control Systems

All of the power supplies were powered on and tested for nominal voltage. Particular attention was paid to the ±2.5V analog electrometer supply, as the noise figure of this supply directly impacts the electrometer noise floor by the CMRR of the electrometer op-amp.

The control software was tested by verifying that the mass spectrometer could run in all modes for several days without crashing. Then the various modes of operation were examined for power consumption. TABLE 1 (below) shows power consumption of each operating mode at 12 VDC. Note that in every mode of operation the instrument draws less power than any other existing miniature mass spectrometer. The ion pump draws 3 W, although this amount of power was not quite enough to sustain the pump.

TABLE 1

Mass Spectrometer Supply Current in Different Operating Modes

| Operating Mode | Current [A] |
|---|---|
| standby | 0.05 |
| idle | 0.30 |
| idle, degas on | 0.55 |
| sweep | 0.60 |

7.2 Electron Beam

Operation of the electron beam is the first diagnostic of a mass spectrometer. Operation is generally characterized by the trap current. The trap current is the fraction of the electron current that is emitted from the filament, passes entirely through the ionization region, and collected at the trap electrode. The trap current should be directly proportional to filament brightness, which is itself a strongly nonlinear function of filament power. Above a certain power level, trap current begins to rise rapidly while filament life decreases.

Filament intensity as a function of filament voltage V is proportional to V^(3.4) while filament lifetime is proportional V^−16, giving a strong incentive not to overdrive the filament. The filament used in this mass spectrometer is that of a standard PR-2 tungsten flashlight bulb. This type of bulb is rated for a 15 hour lifespan at 2.4 V and 0.5 A. Operating at reduced voltage will increase its lifespan. For example, at 2.3 V the filament will retain 86% of its brightness while doubling its lifespan to 30 hours.

The trap current was measured at two different filament voltages, summarized in Table 2.

TABLE 2

Trap Current as a Function of Filament Voltage

| Filament Voltage (V) | Trap Current (μA) |
|---|---|
| 2.0 | 10 |
| 2.2 | 19 |
| 2.4 | 25 |

The trap current was somewhat rather variable during different experiments, dropping to 25 μA to during some tests even at an operating voltage of 2.4 V, possibly due to the fact that the mass spectrometer was frequently disassembled and reassembled, changing the exact orientation of the filament with respect to the ionization region.

7.3 Degas Heater

Figure 20:
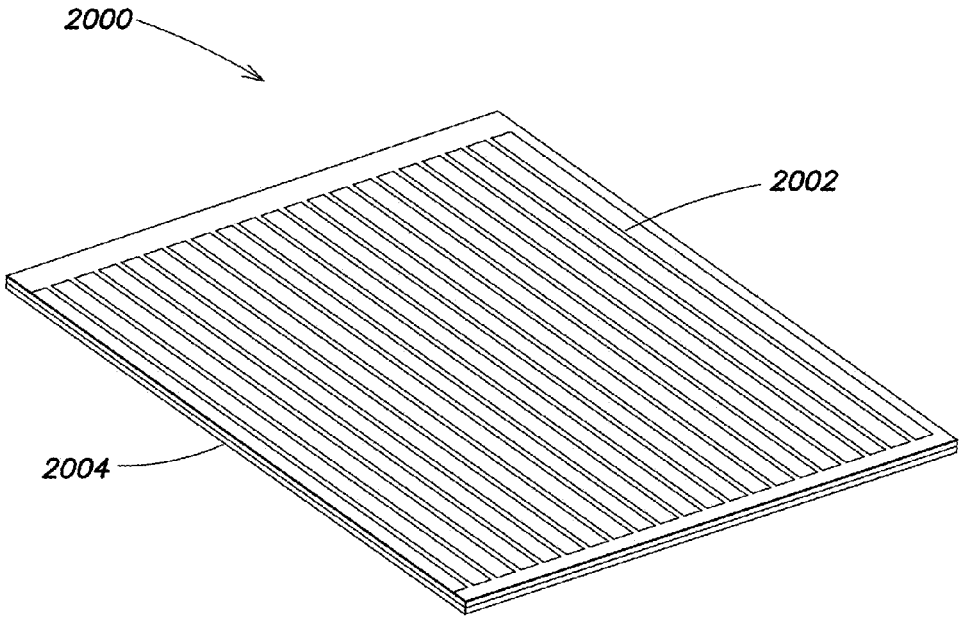
FIG. 20 is a perspective view of a substrate with a degas heater, according to an embodiment of the present invention.

FIG. 20 is a diagram of a degas heater 2000 formed of a network of resistive heaters 2002 connected to a mass spectrometer substrate board 2004, such as substrate 190 (FIG. 1A) or the electronics board 1120 (FIG. 11). The heater 2000 can be used to remove at least some the absorbed and adsorbed gases on these boards by raising the boards' temperature. Turning the heater 2000 involves running a current through the resistive heaters 2002, which in turn causes the resistive heaters 2002 and the board 2004 to heat up. As the board 2004 heats up, it release absorbed and adsorb gas, which is pumped out of the vacuum cavity by the ion pump 120 (FIG. 1A), a separate turbopump attached to the vacuum chamber, or both. When the heater is working properly, it should be possible to turn the heater on under vacuum, see a rise in chamber pressure as gas is driven off, then see the pressure fall to a level below the initial level when the heater is turned off again.

Figure 21:
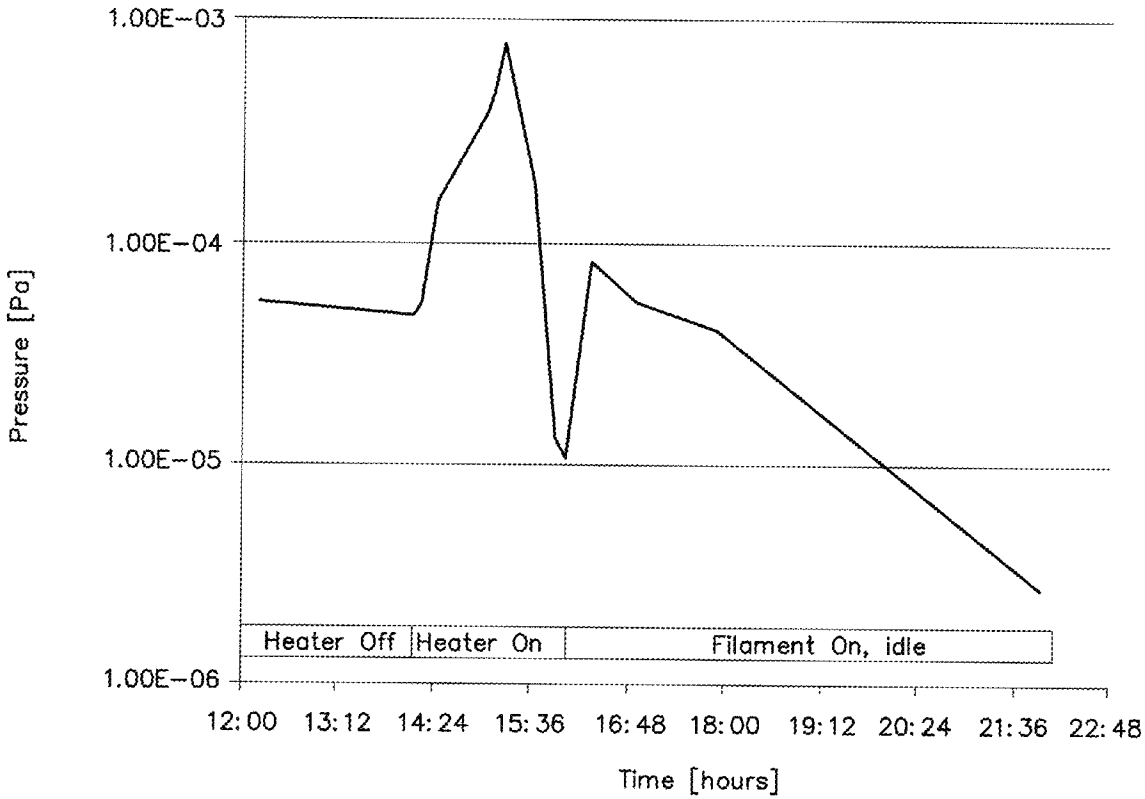
FIG. 21 is a plot of vacuum chamber pressure versus time, with the heater transitions indicated, for an illustrative mass spectrometer according to an embodiment of the present invention.

FIG. 21 is a plot of pressure versus time for an experiment run to test the degas heater. The mass spectrometer was installed in a vacuum housing and pumped down. When the chamber pressure had stabilized, the heater was switched on, then off again approximately three hours later. Note the relatively slow initial decrease in chamber pressure followed by the rise in chamber pressure when the heater was switched on. The gas is driven off and the chamber pressure begins to fall, at which point the heater is then switched off. At this point the power electronics are activated, which produce their own heat and drive gases off the electronics board. In the future these two cycles can be run concurrently, however, they currently produce too much heat to operate simultaneously without damage.

Figure 22:
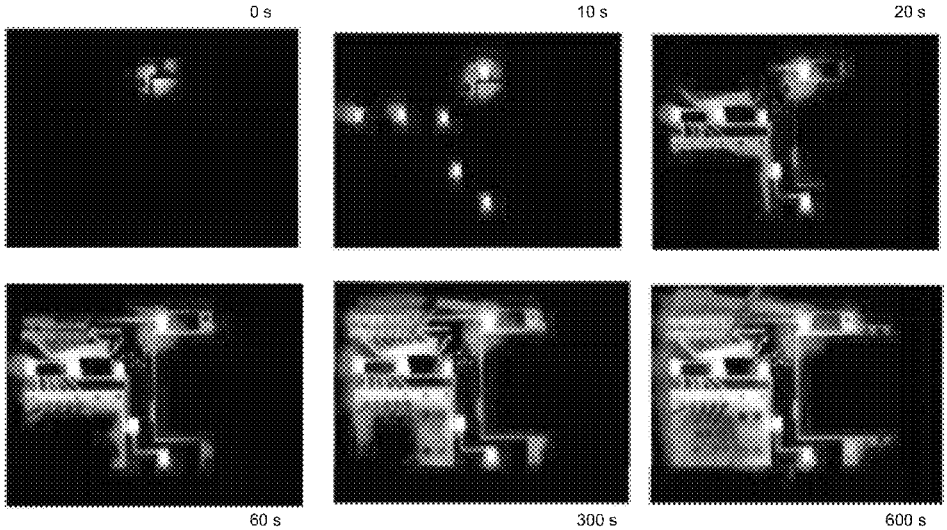
FIG. 22 shows thermal images of an analyzer board taken at 0, 10, 20, 60, 300, and 600 s after activation of a heater according to an embodiment of the present invention; the thermal range is 30° C. (black) to 60° C. (white).

FIG. 22 shows infrared images of a the analyzer board at different time intervals after the heaters are turned on. The mass analyzer board was placed beneath a thermal imaging camera (e.g., a FLIR ThermoVision A40 camera), and the thermal transient behavior observed over ten minutes (600 s). While the temperature rise is modest in absolute value in this series of frames, this experiment was run in air. In vacuum there is no convection to cool the surfaces and the temperature rise should be substantially faster, though the heat will flow roughly in the pattern observed here.

7.4 Lens Linearization

Figure 23:
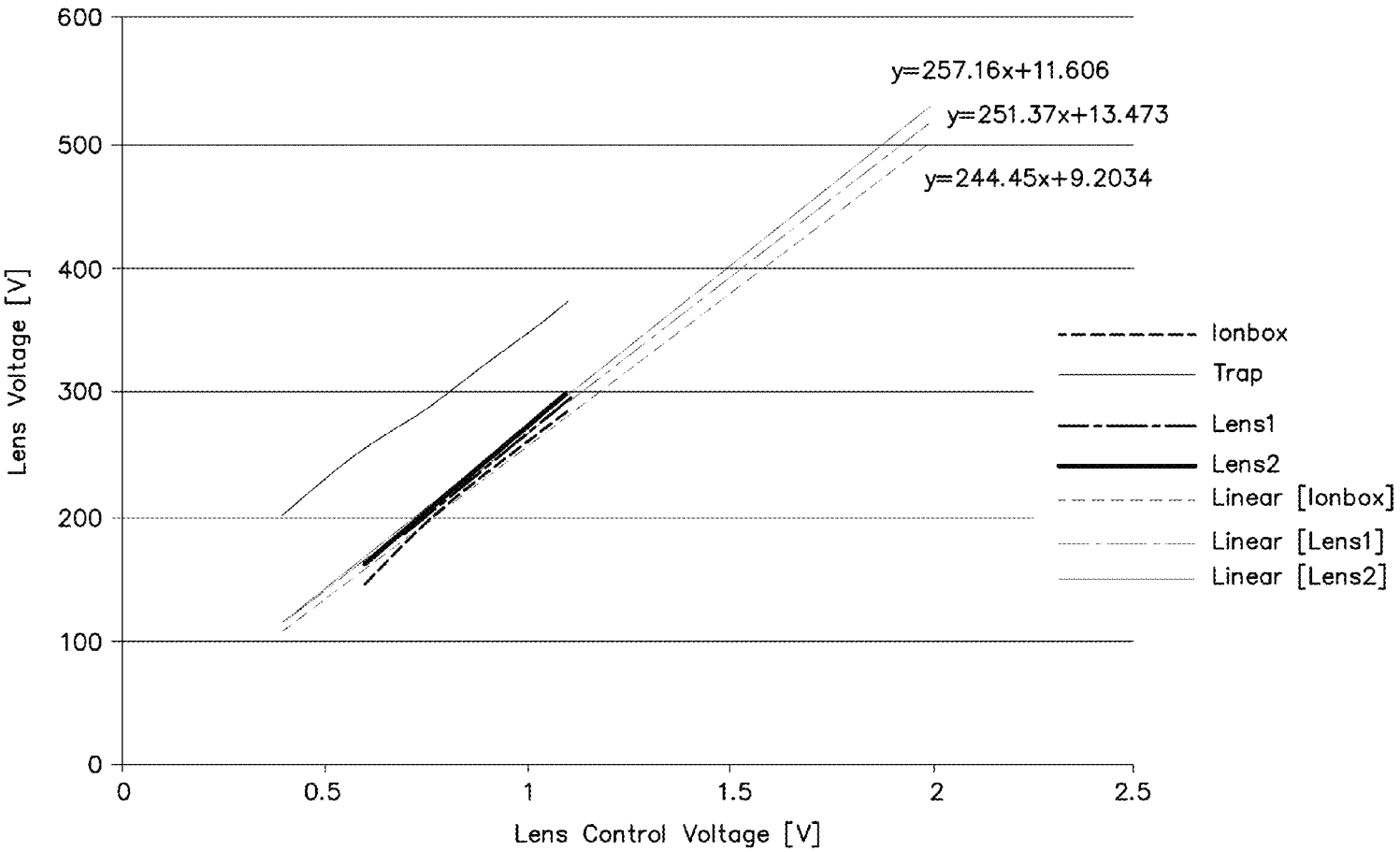
FIG. 23 is a plot of the microprocessor's command voltage versus the actual output of each lens driver for an illustrative mass spectrometer according to an embodiment of the present invention.

FIG. 23 shows the relative calibrations of each lens driver. Despite attempts to ensure that the feedback control loop wrapped around each of the lens drivers was accurate, there was some variation between lens commands and lens voltages. A calibration was thus run on the ion source potential and the two electrostatic lenses. This calibration curve was linearized and programmed into the mass spectrometer controller's code to ensure that the correct voltages are being output to the lenses. While the lens drivers were similar, as they should have been given that they were constructed using identical hardware, they varied by a few volts. This may not seem very important, but the potential energy surface described above indicates how carefully some of these voltages should be aligned; a lens tuned incorrectly can severely limit or block the ion beam, eliminating the signal.

7.5 Ion Pump

The miniature co-fabricated ion pump was tested on its own after the system had been pumped down to 2.6e-6 Pa [2.0e-8 torr]. The ion pump was started at 2.6e-4 Pa [2.0e-6 torr] and operated in conjunction with the vacuum chamber's turbopump until the pressure reached 2.6e-6 Pa, at which point a valve inserted between the turbopump and the chamber was closed.

Figure 24:
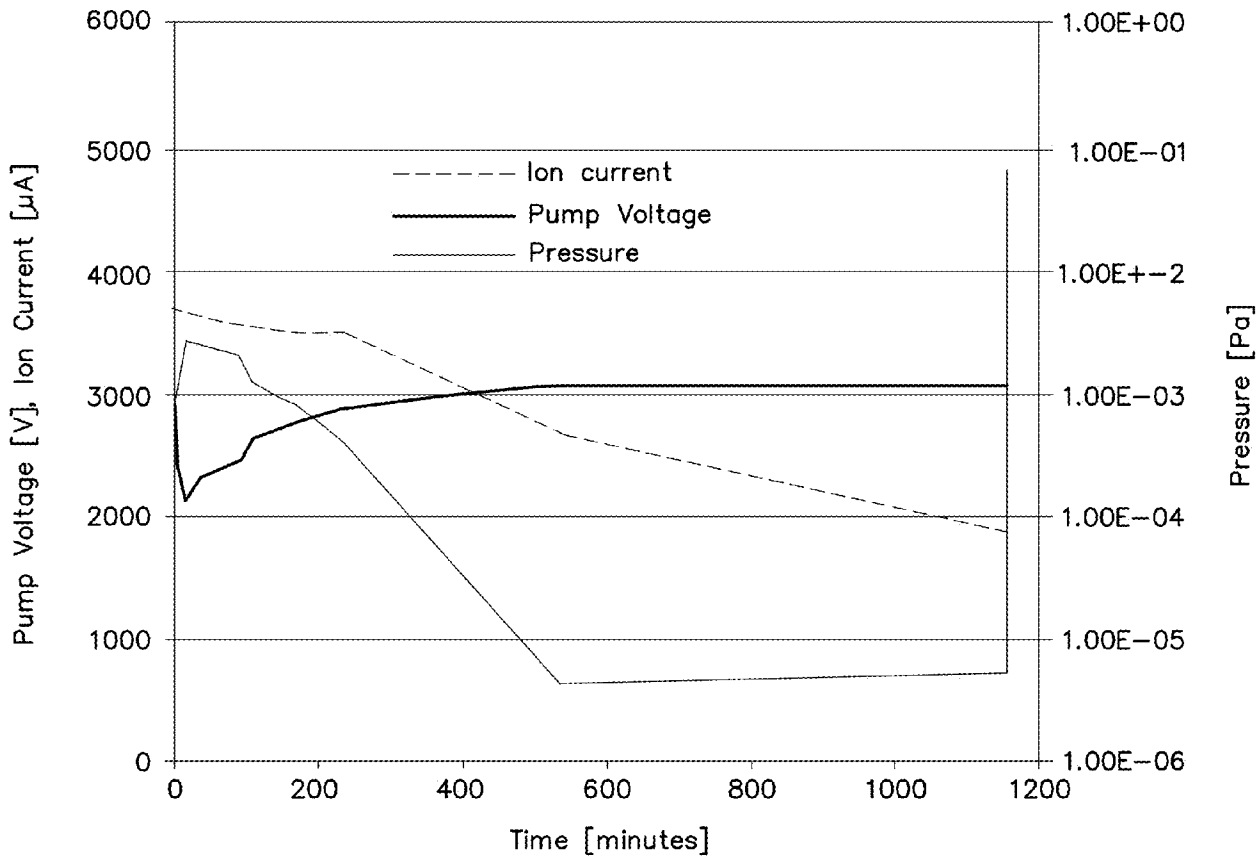
FIG. 24 is a plot of the system pressure, ion pump voltage and ion pump current versus time for an illustrative mass spectrometer according to an embodiment of the present invention.
Figure 25:
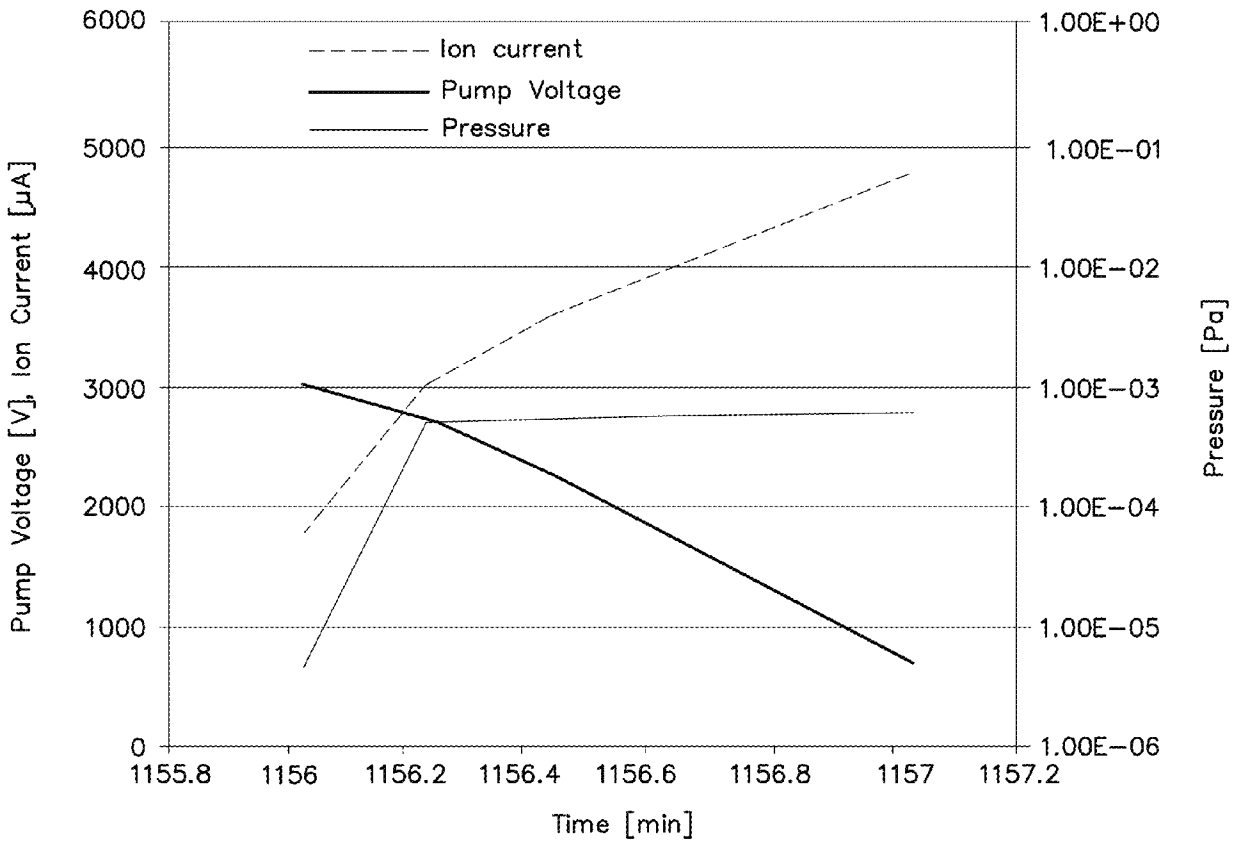
FIG. 25 is a plot of the system pressure, ion pump voltage and ion pump current, in the minutes following segmentation of the vacuum system for an illustrative mass spectrometer according to an embodiment of the present invention.

FIGS. 24 and 25 are plots of the vacuum chamber pressure, pump voltage, and ion current during the commissioning process. At first, the miniature ion pump is heated to drive off the adsorbed gases and is run in conjunction with a second high vacuum pump until the ion pump is ready carry the gas load. This commissioning process takes approximately 15 hours without using the mass spectrometer's onboard heater.

Figure 26:
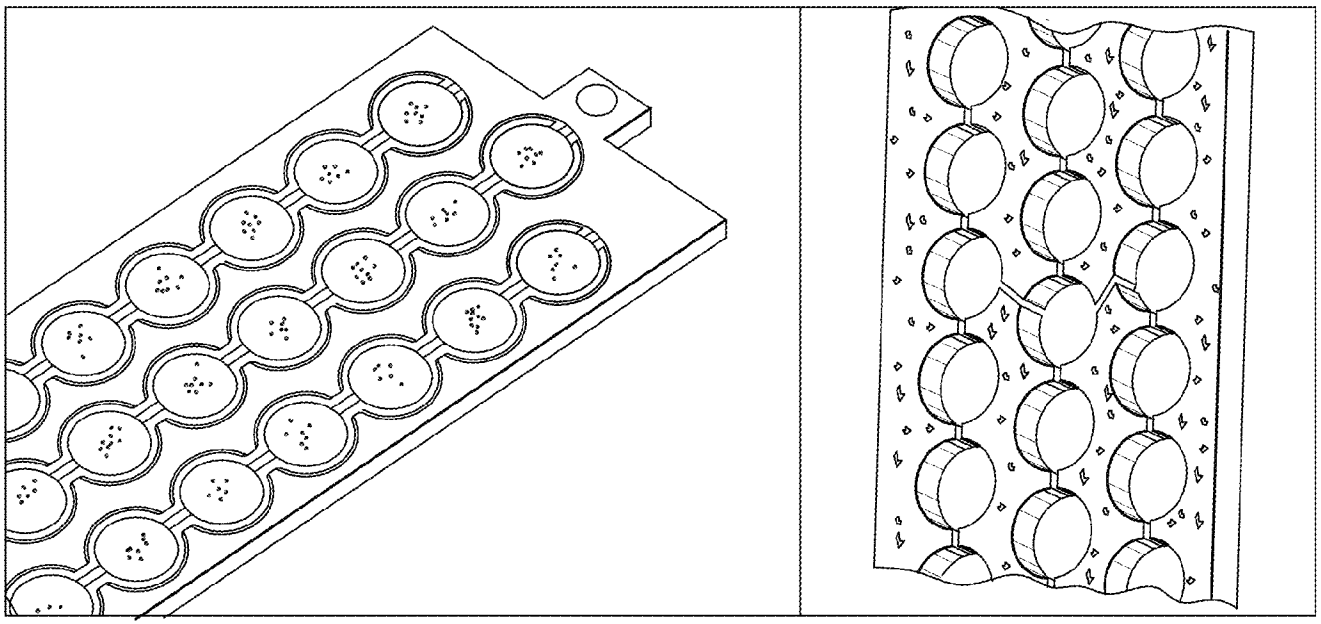
FIG. 26 is a photograph of the plates of a disassembled ion pump according to an embodiment of the present invention; colored deposits are likely chromium from the stainless steel anode.

FIG. 26 includes photographs of the ion pump disassembled afterward commissioning test. The titanium cathode plates were pitted in the center of each pump cell, and the anode was plated with sputtered titanium.

7.6 Mass Spectra

For an inventive mass spectrometer, spectra may appear as ion beam current as a function of ion source potential. While the microprocessor may be programmed to output ion current versus mass to charge ratio, for this example the mapping between ion source potential and m/z is done in post-processing of the data. Alternatively, an inventive mass spectrometer may measure high-voltage biased parameters (e.g., filament current, trap current).

Large numbers of mass sweep tests were run on the miniature mass spectrometer. Between tests, many optimizations were made based on the resultant data. Optimizations were generally minor and included adjusting the variable-geometry mass analyzer slits, electrometer hardware (e.g., feedback resistor, capacitor), and modifying the software to optimize filament power, electrostatic lens potentials and ion source voltage sweep rate and range.

Figure 27:
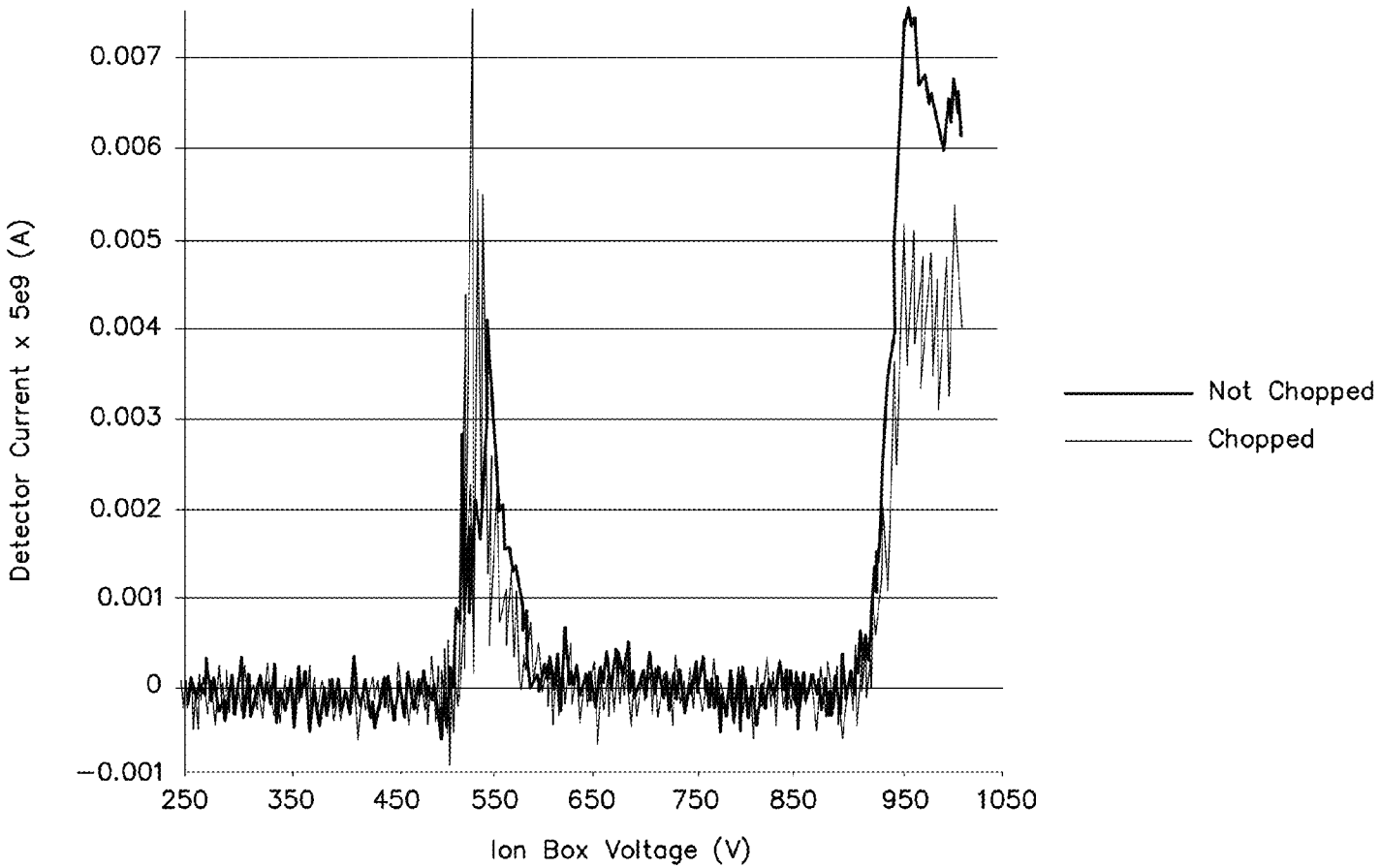
FIG. 27 is a mass spectrograph captured by an illustrative mass spectrometer according to an embodiment of the present invention.

FIG. 27 shows a mass spectrum collected from an exemplary miniature mass spectrometer. The large centered peak is likely nitrogen while the peak on the right side of the graph is water. Oxygen likely appears, as a peak protruding from the left shoulder of the nitrogen peak; this exemplary mass spectrometer did not have sufficient resolution to separate masses that were distant by 4 AMU. This spectrum shows that the ion beam has been chopped using the digital controller to modulate one of the electrodes.

Figure 28:
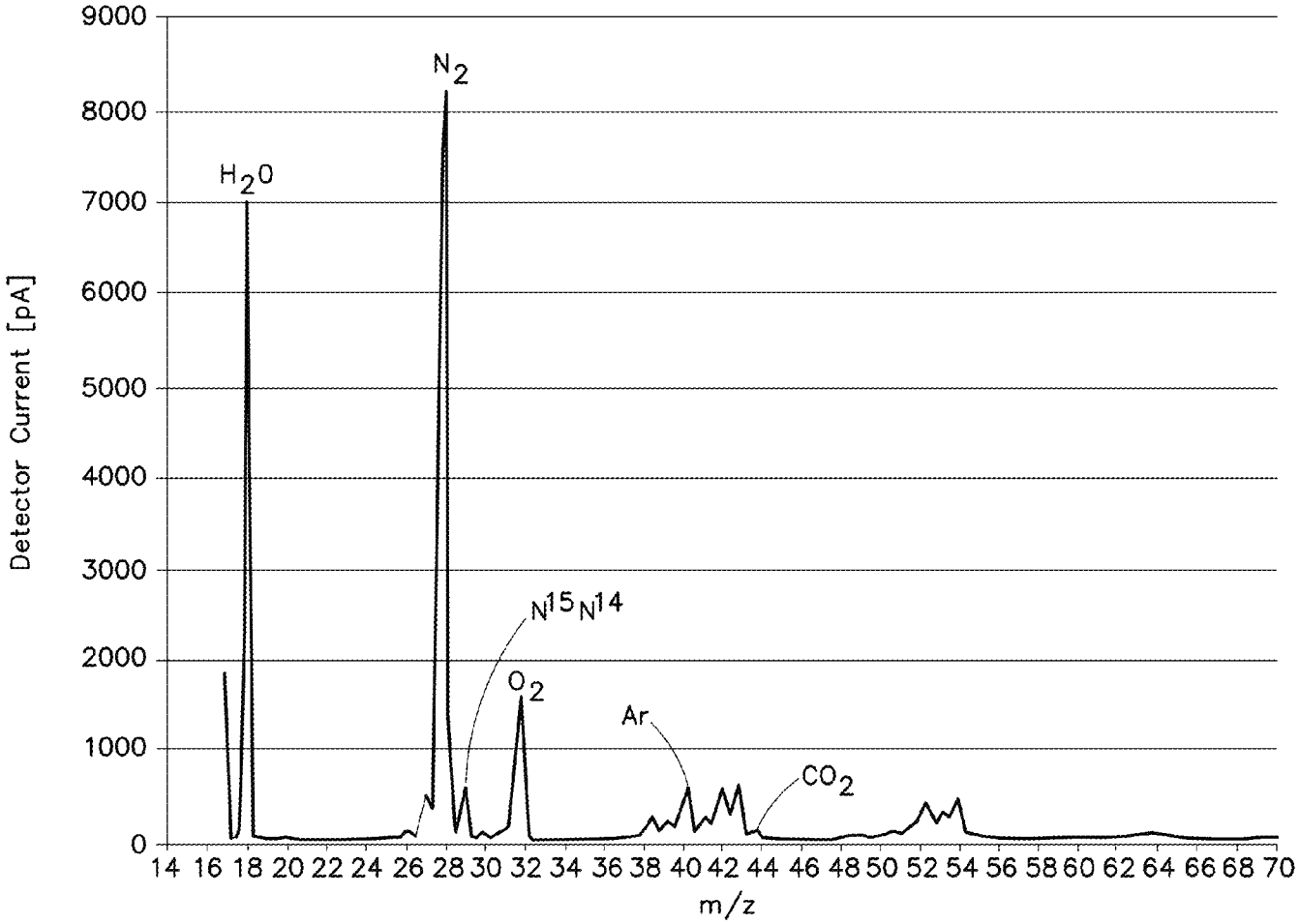
FIG. 28 is a mass spectrograph of air captured by another illustrative mass spectrometer according to an embodiment of the present invention.

FIG. 28 is a mass spectrum captured by the another version of the mass spectrometer, with prominent peaks highlighted. The data have been corrected for the inverse relationship between acceleration potential and mass/charge ratio. Note the peak at m/z of 29, this is likely an isotope of nitrogen, 15N14N, which is present in air with a 0.36% abundance relative to 14N14N.

One interesting feature observed is that the mass spectrometer functions, albeit with a lower signal to noise ratio, even if the electrostatic lenses are disabled (e.g., the lens is programmed not to alter the beam). This result was used to characterize the effect of the electrostatic lenses.

Figure 29:
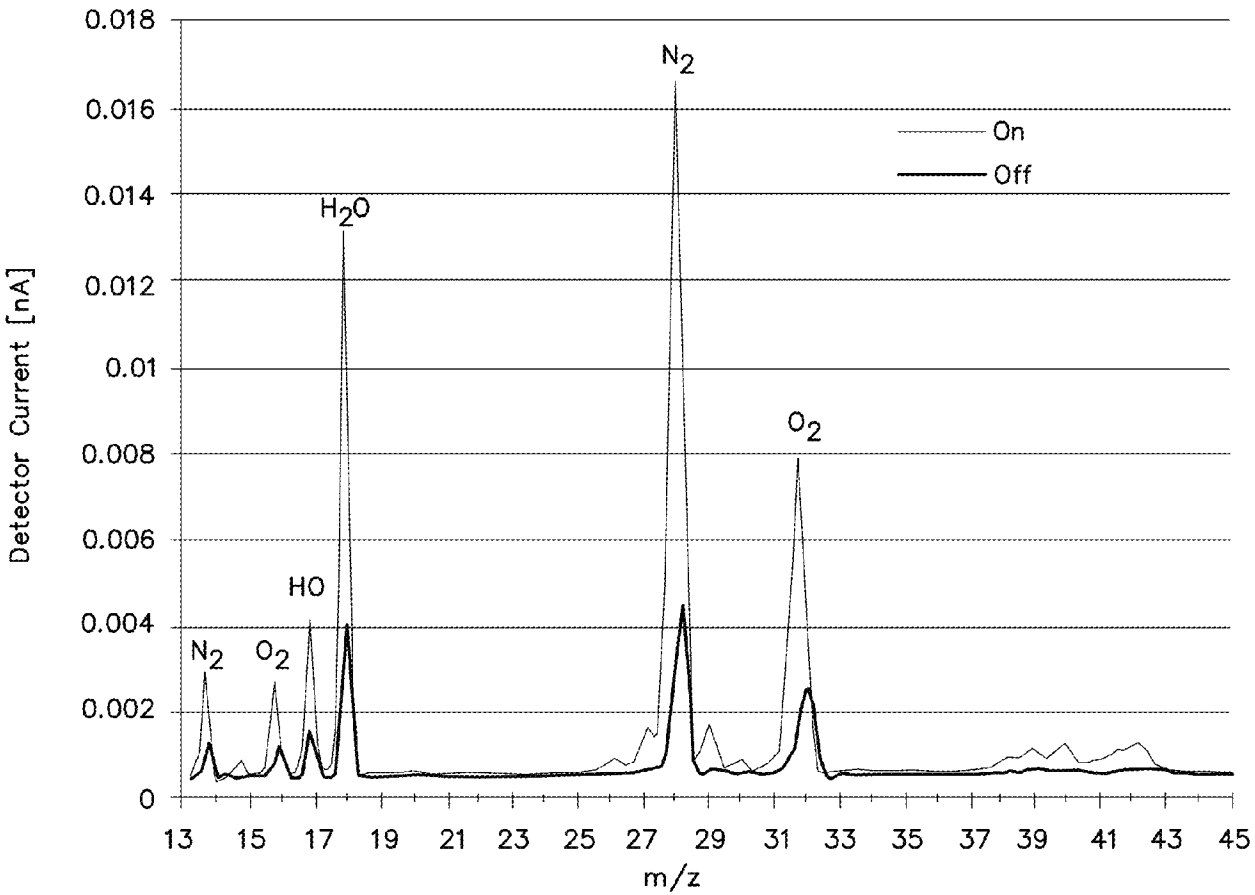
FIG. 29 is a mass spectrograph indicating the value of capturing and using a larger fraction of the ions generated by the electron beam with active electrostatic lenses (upper curve) and disabled electrostatic lenses (lower curve).

FIG. 29 is a pair of spectra, one run with the lenses off, and another run with the lenses on. The lenses give nearly a factor of ten increase in signal strength without increasing the noise floor. This is extremely valuable in mass spectrometry, and shows how attention to capturing and analyzing a larger fraction of the ions generated can produce a stronger signal. The lenses were tuned initially by hand; the ion source was set to a potential with a known ion species, and the lenses were then tuned for maximum signal. Several ions were tuned and the resultant curve fitted with a linear interpolation.

Figure 30:
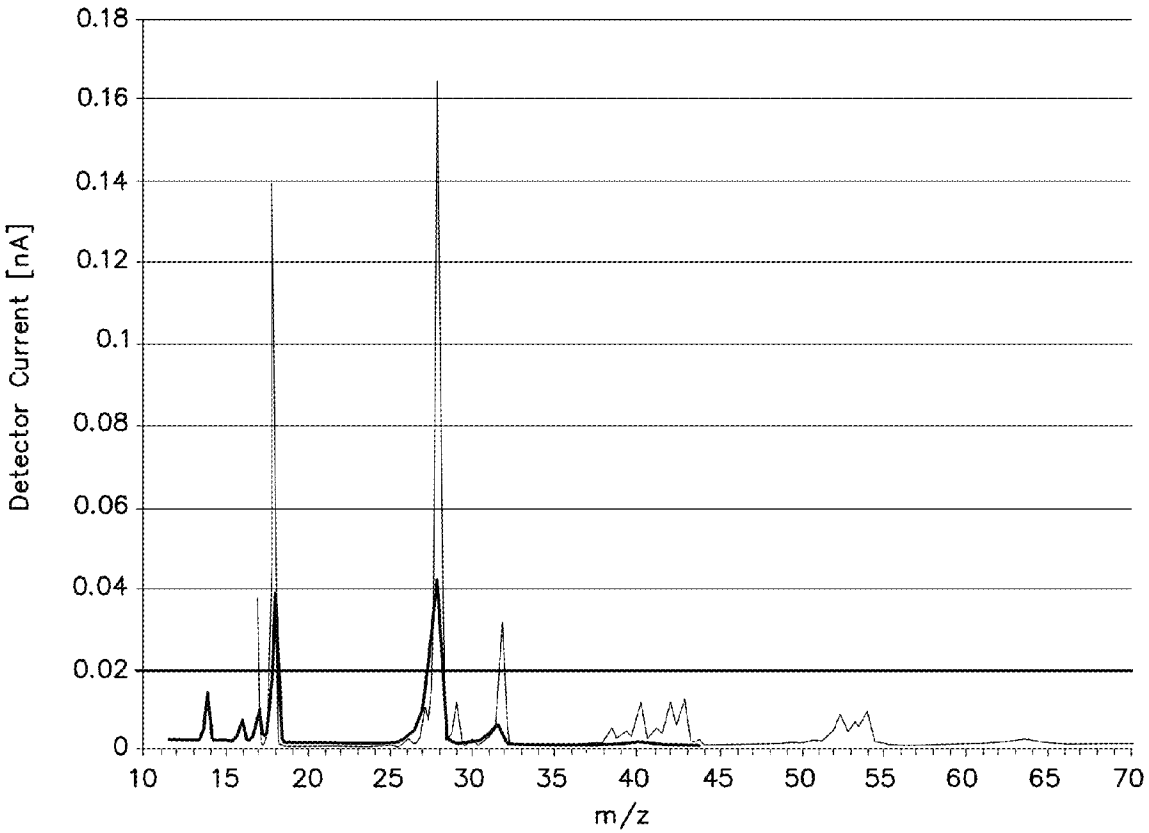
FIG. 30 is a mass spectrograph indicating the effectiveness of narrowing the slits that filter the ion beam according to an embodiment of the present invention. Peaks such as m/z 27 and 26 are invisible with wider slits (lower curve), but readily visible with narrow slits (upper curve).

FIG. 30 is a mass spectrum of air indicating the effectiveness of the variable geometry slits. Although several other factors have changed, including the overall gain of the system, the salient features of this comparison are visible at the bases of the peaks. The peak for m/z 27 and 26 are both visible in the red curve, with narrower slits, while they are completely invisible in the blue curve, made with wider slits.

Figure 31:
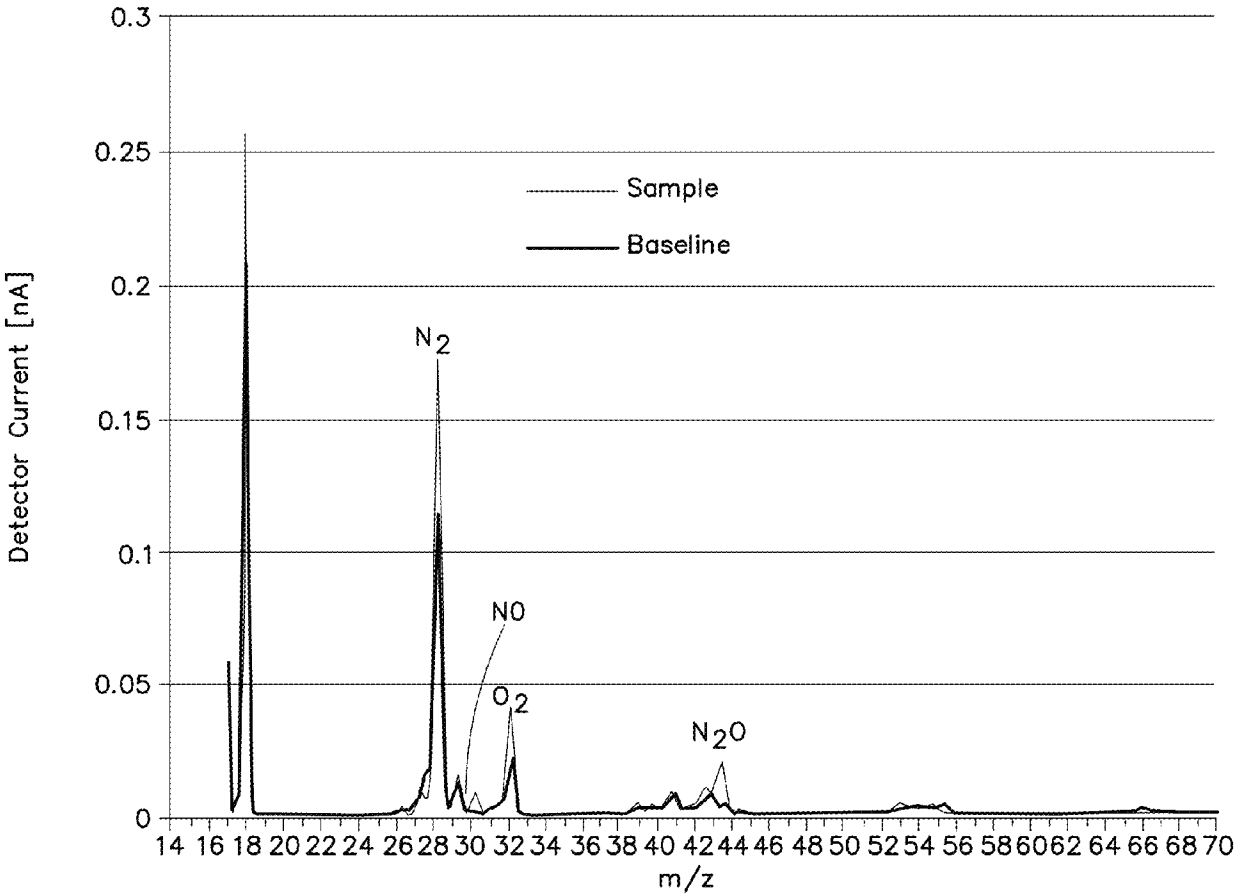
FIG. 31 is a mass spectrograph showing the detection of a new species, nitrous oxide or $N_2O$, and its fragmentary component NO, with an illustrative mass spectrometer according to an embodiment of the present invention.

FIG. 31 is a plot that shows that the illustrative mass spectrometer can detect a new species entered into the inlet. FIG. 31 is a test of the mass spectrometer's detection capabilities. A sample of nitrous oxide ($N_2O$) was injected into the inlet and the mass spectrum sweep run. The control run, in blue, shows the standard spectrum; water, nitrogen, oxygen. The run containing nitrous oxide shows several new peaks. $N_2O$ shows up quite clearly at m/z 44, and another species, the fragmentary ion NO shows up between oxygen and nitrogen, at m/z 30.

Figure 32:
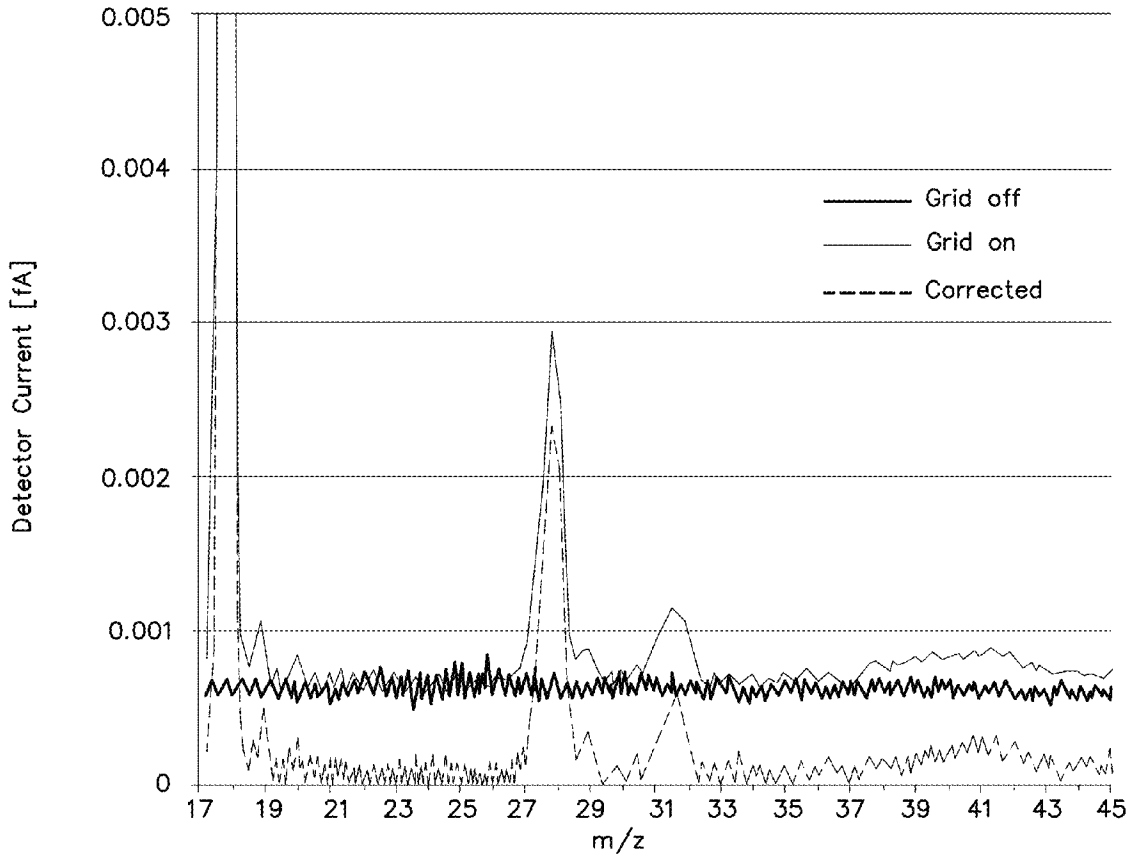
FIG. 32 is a mass spectrum captured using the mass spectrometer's electron source grid (control electrode) to generate a trace that could be subtracted from the signal to remove the electrometer offset and drift.

FIG. 32 is a series of spectra generated using the grid as a modulation source. The grid (control electrode) of the ion source was used to remove the background drift, or 1/f noise, of the electrometer. The blue curve is the baseline curve, generated when the grid is biased such that the ion beam is cut off. The red curve is the signal curve, generated with the ion beam enabled. The green curve is a subtraction of the two, the signal with the baseline offset and drift removed.

These plots show inventive mass spectrometers work with resolution that is sufficient for many tasks, including, but not limited to use as a medical, environmental, or industrial tool. In at least one case, the experimental results indicate that the mass spectrometer is sensitive enough to detect species comprising less than 0.5% of the inlet sample gas, and with a mass resolution of 1 AMU. The noise floor is extremely low, below 10 fA, as indicated on the graph in FIG. 28. Deconvolution with an appropriate function may yield even narrower spectra.

8.0 CONCLUSION

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A mass spectrometer comprising:

(A) a vacuum housing defining a vacuum cavity to support a vacuum of about $10^{-5}$ mm Hg or less;

(B) an electrode, disposed within the vacuum cavity and configured to be charged to an electrode potential, to control acceleration of a charged particle propagating through the vacuum cavity;

(C) a conversion circuit, disposed within the vacuum cavity, to convert an input voltage from a power source outside the vacuum cavity so as to provide the electrode potential for the electrode; and (D) a feedthrough having a dielectric strength of less than or equal to about 36 V to provide an electrical connection between the conversion circuit and the power source;

(E) control electronics, disposed within the vacuum cavity and operably coupled to the conversion circuit, to vary the electrode potential; and (F) a heater, operably coupled to the control electronics and in thermal communication with at least one component within the vacuum cavity, to heat the at least one component in response to a signal from the control electronics so as to drive gas off the at least one component.

2. The mass spectrometer of claim 1, wherein the charged particle is an electron.

3. The mass spectrometer of claim 2, further comprising:

an electron source, disposed within the vacuum cavity, to provide the electron;

a cathode to repel the electron; and an anode, disposed opposite the electrode from the electron source, to accelerate the electron toward an analyte particle to be analyzed.

4. The mass spectrometer of claim 3, wherein the conversion circuit is further configured to provide:

(i) an anode potential of about 100 V to about 5 kV for the anode; and (ii) a cathode potential about 70 V below the anode potential for the cathode, wherein the electrode potential is between about 0 V and about 140 V below the anode potential.

5. The mass spectrometer of claim 1, wherein the conversion circuit is configured to convert the input voltage, having a first value of about 1 V to about 36 V, to the electrode potential, having a second value of about 100 V to about 5 kV.

6. The mass spectrometer of claim 1, wherein the feedthrough is the only electrical connection between the inside and the outside of the vacuum cavity.

7. A mass spectrometry method comprising:

(A) heating at least one component in a vacuum cavity in response to a signal from control electronics so as to drive gas off the at least one component (B) providing a vacuum cavity evacuated to a pressure of about $10^{-5}$ mm Hg or less;

(C) receiving an input voltage from a power source outside the vacuum cavity;

(D) converting the input voltage to an electrode potential with a conversion circuit disposed within the vacuum cavity;

(E) charging an electrode within the vacuum cavity to the electrode potential; and (F) accelerating a charged particle within the vacuum cavity with the electrode charged in (E).

8. The method of claim 7, wherein the input voltage is about 3 V to about 36 V and the electrode potential is about 100 V to about 5 kV.

9. The method of claim 7, wherein the charged particle is an electron, and wherein (F) further comprises:

(F1) varying the electrode potential to control acceleration of the electron.

10. The method of claim 9, wherein (F1) comprises:

controlling the electrode potential with an electronic component disposed within the vacuum cavity.

11. The method of claim 7, wherein the charged particle is an ionized analyte particle, and further comprising:

(G) determining a mass of the ionized analyte particle based on acceleration of the charged particle.

12. A mass spectrometer comprising:

(A) a vacuum housing defining a vacuum cavity;

(B) a magnet in a magnetic yoke that defines at least one gap, to generate a magnetic field having a first strength in a first region within the at least one gap and a second strength in a second region within the at least one gap;

(C) an ion pump, positioned so as to be in the first region within the at least one gap, to maintain a vacuum pressure of the vacuum cavity;

(D) a mass analyzer, positioned so as to be in the second region within the at least one gap, to determine a mass of an ionized analyte particle propagating through the vacuum cavity;

(E) a control electrode, disposed within the vacuum cavity, to control acceleration of an electron that ionizes the analyte particle;

(F) a conversion circuit, disposed within the vacuum cavity, to provide a converted voltage to the ion pump, the control electrode, and/or the mass analyzer;

(G) control electronics disposed within the vacuum cavity and operably coupled to the conversion circuit to vary a potential of the control electrode; and (H) a heater, operably coupled to the control electronics and in thermal communication with at least one component within the vacuum cavity, to heat the at least one component in response to a signal from the control electronics so as to drive gas off the at least one component.

13. The mass spectrometer of claim 12, wherein the magnet in the magnetic yoke is configured such that the first strength is about 0.1 Tesla and the second strength is about 0.7 Tesla when the magnetic field is generated.

14. The mass spectrometer of claim 12, wherein the mass analyzer is a magnetic sector analyzer.

15. The mass spectrometer of claim 12, further comprising:

signal processing electronics, disposed within the vacuum cavity and configured to be powered by the conversion circuit, to process signals provided by the mass analyzer.

16. The mass spectrometer of claim 12, further comprising:

an electron source, disposed within the vacuum cavity, to provide the electron;

a cathode to repel the electron; and an anode, disposed on opposite the control electrode from the electron source, to accelerate the electron toward the analyte particle.

17. The mass spectrometer of claim 16, wherein the conversion circuit is further configured to provide:

(i) an anode potential of about 100 V to about 5 kV for the anode;

(ii) a cathode potential about 70 V below the anode potential for the cathode; and (iii) a control potential about 0 V and about 140 V below the anode potential for the control electrode.

18. The mass spectrometer of claim 16, wherein the conversion circuit is configured to provide the converted voltage, having a first value of about 100 V to about 5 kV, from an input voltage, having a second value of about 1 V to about 36 V.

19. The mass spectrometer of claim 1, wherein the control electronics comprise at least one digital-to-analog converter to set the electrode potential for the electrode.

20. The mass spectrometer of claim 1, wherein the heater comprises a network of resistive heating elements disposed on a substrate.

21. The mass spectrometer of claim 1, further comprising:

(I) an ion pump, disposed within the vacuum cavity, to pump the gas out of the vacuum cavity so as to maintain the vacuum of about $10^{-5}$ mm Hg or less.

22. The mass spectrometer of claim 1, further comprising:

(J) a wireless communications interface, operably coupled to the control electronics, to relay data and instructions between the inside of the vacuum cavity and the outside of the vacuum cavity.

23. The mass spectrometer of claim 12, wherein the control electronics comprise at least one digital-to-analog converter to set the electrode potential for the electrode.

24. The mass spectrometer of claim 12, wherein the heater comprises a network of resistive heating elements disposed on a substrate.

25. The mass spectrometer of claim 12, further comprising: a wireless communications interface, operably coupled to the control electronics, to relay data and instructions between the inside of the vacuum cavity and the outside of the vacuum cavity.

* * * * *

UNITED STATES PATENT AND TRADEMARK OFFICE

CERTIFICATE OF CORRECTION

PATENT NO. : 8,754,371 B2
APPLICATION NO. : 13/396321
DATED : June 17, 2014
INVENTOR(S) : Ian W. Hunter, Brian D. Hemond and Harold F. Hemond It is certified that error appears in the above-identified patent and that said Letters Patent is hereby corrected as shown below:

In the Claims:

Line 11 of Claim 1 (Column 35, line 19) should read, "potential for the electrode; [[and]]"

Line 5 of Claim 7 (Column 35, line 59) should read, "(B) providing [[a]] the vacuum cavity evacuated to a pressure of"

Line 3 of Claim 12 (Column 36, line 20) should read, "(B) a magnet, in a magnetic yoke that defines at least one"

Signed and Sealed this
Twenty-third Day of September, 2014

Michelle K. Lee

Michelle K. Lee
*Deputy Director of the United States Patent and Trademark Office*